US005414241A

United States Patent [19]

Ohashi et al.

[11] Patent Number: 5,414,241

[45] Date of Patent: May 9, 1995

[54] HEATER, A METHOD OF MANUFACTURING THE SAME, AND AN ANTI-CONDENSATION MIRROR INCORPORATING THE SAME

[75] Inventors: Keiichi Ohashi, Shizuoka; Yoshinobu Ohara, Nara; Fumitaka Ishimori, Kitakatsuragi, all of Japan

[73] Assignee: Sekisui Kaseihin Kogyo Kabushiki Kaisha, Nara, Japan

[21] Appl. No.: 55,111

[22] Filed: May 3, 1993

[30] Foreign Application Priority Data

May 11, 1992 [JP] Japan ..... 4-030617
May 11, 1992 [JP] Japan ..... 4-117722
Sep. 25, 1992 [JP] Japan ..... 4-256620

[51] Int. Cl.[6] ..... H05B 3/02

[52] U.S. Cl. ..... 219/219; 29/611; 219/505; 219/544

[58] Field of Search ..... 219/219, 505, 504, 544, 219/552, 553, 548, 549, 541, 536, 537; 29/611, 612, 621; 338/22 R, 22 SD

[56] References Cited

U.S. PATENT DOCUMENTS

| | | | |
|---|---|---|---|
| 3,824,328 | 7/1974 | Ting et al. | 338/22 R |
| 4,029,896 | 6/1977 | Skinner | 219/541 |
| 4,045,763 | 8/1977 | Miyamoto et al. | 219/504 |
| 4,104,509 | 8/1978 | Van Bokestal et al. | 219/544 |
| 4,210,800 | 7/1980 | Van Bokestal et al. | 219/544 |
| 4,230,935 | 10/1980 | Meixner | 219/504 |
| 4,236,065 | 11/1980 | Yashin et al. | 219/505 |
| 4,331,860 | 5/1982 | Roller et al. | 219/544 |
| 4,368,380 | 1/1983 | Igashira et al. | 219/541 |
| 4,395,623 | 7/1983 | Shimada et al. | 219/544 |
| 4,544,829 | 10/1985 | Adachi et al. | 219/505 |
| 4,631,391 | 12/1986 | Tiepke | 219/505 |
| 4,665,302 | 5/1987 | Bergersen | 219/541 |
| 4,689,878 | 9/1987 | Beauregard et al. | 219/505 |
| 4,728,779 | 3/1988 | Kotani et al. | 219/505 |
| 4,831,241 | 5/1989 | Shikama et al. | 219/504 |
| 4,835,370 | 5/1989 | Van Bokestal et al. | 219/541 |
| 4,933,533 | 6/1990 | Simpson | 219/219 |
| 5,015,824 | 5/1991 | Monter | 219/219 |
| 5,263,115 | 11/1993 | Kano et al. | 219/505 |

FOREIGN PATENT DOCUMENTS

| | | |
|---|---|---|
| 2641894 | 3/1977 | Germany . |
| 2715878 | 11/1977 | Germany . |
| 47-26226 | 8/1972 | Japan . |
| 48-65497 | 8/1973 | Japan . |
| 53-47500 | 12/1978 | Japan . |
| 57-104966 | of 1982 | Japan . |
| 58-53498 | 4/1983 | Japan . |
| 60-155371 | 10/1985 | Japan . |
| 1-197154 | 7/1989 | Japan . |
| 3-9283 | 3/1991 | Japan . |

*Primary Examiner*—Geoffrey S. Evans
*Attorney, Agent, or Firm*—Nikaido, Marmelstein Murray & Oram

[57] ABSTRACT

A heater includes a heating element made of a PTC thermistor, electrodes formed on upper and lower surfaces of the heating element, flat metallic terminals connected to the electrodes, lead wires connected to inner surfaces of the metallic terminals that face each other, and an insulating case for covering exposed portions of the heating element, electrodes, and of the metallic terminals, and the connections between the lead wires and the metallic terminals. With this structure, since no bumps are produced on the outer surfaces of the metallic terminals by connecting the lead wires to the metallic terminals, the thickness of the insulating case over the metallic terminals is reduced. This allows a reduction in the thickness of the heater and an improved heat transfer between the heating element and the heated object. A method of manufacturing the heater includes the steps of forming a heating unit by connecting the flat metallic terminals to the electrodes and connecting the lead wires to the metallic terminals, disposing the heating unit on a predetermined position of the base section of the insulating case, and sealing the exposed portions of the heating unit in the insulating case by injection-molding a cover section of the insulating case with insulating material after disposing the base section in a mold. This method enables the heating unit to be easily covered with the insulating case, thereby facilitating the manufacture of the heater.

38 Claims, 26 Drawing Sheets

55
55k
55u
55g
55h
55i
55j
55a
55b
55c
55d
55e
55f
55t
58
59
60
26D 63
63a
63b
63c
63d
63e
63f
63g
63h
63i
63j
63k
63m
63n
63o
63p
63q
63r
63s
63t
63u

HEATER, A METHOD OF MANUFACTURING THE SAME, AND AN ANTI-CONDENSATION MIRROR INCORPORATING THE SAME

FIELD OF THE INVENTION

The present invention relates to a heater which is produced from a material having a PTC (Positive Temperature Coefficient) of resistance, for example, semiconductor ceramics of a barium titanate system and used as a uniform-temperature heater or local heater in various fields, and to a method of manufacturing the heater. The present invention also relates to an anti-condensation mirror for use in a high humidity environment such as a bathroom, having the heater for preventing condensation from forming on the mirror surface.

BACKGROUND OF THE INVENTION

A heater incorporating a plate-like heating element made of a PTC thermistor is conventionally known. The PTC thermistor is a heating element having a positive temperature coefficient of resistance and, for example, is produced from a PTC material such as semiconductor ceramics of a barium titanate system. The PTC thermistor has low resistance at temperatures ranging from room temperature to Curie temperature Tc (resistance transition temperature) and a rapid increase in the resistance when the temperature exceeds the Curie temperature Tc. With this characteristic, when a voltage is applied to the heating element, the heating element draws high currents initially as the resistance is low at low temperatures, resulting in a rapid increase in the temperature. On the other hand, the temperature of the heating element does not exceed a predetermined temperature because the resistance increases rapidly when the temperature exceeds the Curie temperature Tc. Thus, the heating element constantly maintains the predetermined temperature. Namely, the heating element including the PTC thermistor has self-controlling temperature characteristics. Accordingly, there is no need for a heater with such a heating element to have circuits for controlling the heated temperature to be a predetermined temperature and for preventing overheating. Additionally, such a heater is very safety.

A heater of this type is disclosed in Japanese Publication for Examined Utility Model Application No. 26226/1972. The structure of the heater is as follows. Electrodes are formed on the upper and lower surfaces of a plate-like heating element made of a PTC thermistor. A terminal board is mounted on the outer surface of each electrode, a heat transfer board is mounted on the outer surface of one of the terminal boards, and an electrical insulating board is mounted on the outer surface of the other terminal board. Japanese Publication for Unexamined Utility Model Application No. 53498/1983 also discloses a heater of this type. The heater of this document is constructed such that electrodes are formed on the upper and lower surfaces of a plate-like heating element made of a PTC thermistor, an electrode board or a terminal board is mounted on the outer surface of each electrode, and an electrical insulating board is mounted on the outer surface of each terminal board. In these heaters, lead wires as feeders are connected to the terminal boards by, for example, a solder. Electrical power is supplied to the heating element by connecting the lead wires to a power supply.

However, these structures fail to provide sufficient insulation, and therefore the safety of the heaters drops, particularly, in a high humidity environment.

Japanese Publication for Examined Utility Model Application No. 9283/1991 discloses a heater which solves such problems. In this heater, electrodes are formed on the upper and lower surfaces of a plate-like heating element made of a PTC thermistor, and lead wires are soldered to the outer surfaces of the electrodes. And, the heating element, the electrodes and the connections of the lead wires and the electrodes are coated with a heat-conductive electrical-insulating resin, such as a silicone resin.

With this structure, satisfactory insulation is achieved. However, since the lead wires are soldered to the outer faces of the electrodes, the heat conductive insulating resin coat is needed to have a thickness which covers up bumps on the electrode surfaces caused by the soldering of the lead wires, resulting in an increase in the thickness of the resin layer. Consequently, the heater with this structure becomes rather thicker and larger, but is not capable of efficiently conducting heat from the heating element to an object to be heated.

In addition, when the heater incorporating a PTC thermistor as a heating element is used, if the heating element is not coated well or the insulation structure is not appropriate, the electrical characteristics may deteriorate, causing electrical insulation defect and variations in the electric resistance. Such deterioration is caused by dust and humidity in the atmosphere. In particular, when dew is formed on the electrode surface of the heating element, that moisture causes an electrical chemical reaction on the electrode surface upon the application of a voltage. This may cause the electric resistance to vary considerably. In order to solve such a problem, Japanese Publication for Examined Patent Application No. 47500/1978 and Examined Utility Model Application No. 9283/1991 disclose heating elements covered with an electrical insulating cover member such as a resin material.

For instance, with a covering method disclosed in the above Japanese Examined Patent Application No. 47500/1978, a heating unit formed by connecting lead wires to a heating element is covered with an electrical insulating cover member. In this case, in order to position the heating unit more easily and properly in the electrical insulating cover member formed by molding, the covering is performed through the following processes.

Firstly, a plastic pot having an open top and a base with holes for the corresponding lead wires of the heating unit is prepared. Secondly, the heating unit is placed in the pot while pulling out the lead wires through the holes. Next, the lead wires are fastened to the holes with a sealer so that the heating element is positioned at the center of the pot and that the holes are completely sealed. Then, an epoxy series resin material is injected into the pot and hardened.

However, this conventional method requires minute work including pulling out the lead wired through the holes of the pot, positioning the heating element at the center of the pot using tweezers and fixing the lead wires to the holes with a sealer. In other words, complicated work is required to cover the heating unit with the electrical insulating covering material. Meanwhile, Japanese Publication for Examined Utility Model Application No. 9283/1991 does not disclose any method for solving the above-mentioned problems.

In a room with high humidity such as a bathroom, an anti-condensation mirror capable of preventing condensation from forming on the mirror by heating is conventionally used.

Japanese Publication for Unexamined Utility Model Application No. 155371/1985 discloses an anti-condensation mirror of this type. As described in the document, in the anti-condensation mirror, a plate-like heating element is attached to the rear surface of a mirror and the front surface of the mirror is heated by conducting electricity to the heating element. For example, the plate-like heating element is a film-like heating element formed by applying a thermal coating containing carbon and metal to a heat-resistant polymer film.

In the case of another anti-condensation mirror, a sheathed heater is attached to the rear surface of the mirror, and the front surface of the mirror is heated by conducting electricity to the sheathed heater. For example, the sheathed heater is a heating cable element formed by covering metallic wires with a heat-resistant polymer.

With these structure, however, in order to maintain the temperature of the heating element at a predetermined temperature and to ensure safety, it is necessary to provide a temperature control circuit and a circuit for preventing overheating. Consequently, the size of the anti-condensation mirror becomes larger. Additionally, when the film-like heating element is attached to the rear surface of the mirror, if a layer of air is produced between the film-like heating element and the mirror and if electricity is conducted to the heating element under this condition, there is a possibility of producing heat and causing fire. The reason for this is that the layer of air separates film-like heating element from the mirror at an area, and therefore the heat produced at the area can not escape, resulting in localized overheating. In the case of an anti-condensation mirror using the heating cable element, it is difficult to fasten the heating element closely to the rear surface of the mirror, resulting in low conductivity of the heat from the heating element to the mirror.

In order to overcome such difficulties, various types of anti-condensation mirrors incorporating a heater having a heating element made of the PTC thermistor as a heat source are suggested. With this structure, since the PTC thermistor has the self-controlling temperature characteristics, it is possible to omit the temperature control circuit and the circuit for preventing overheating, enabling a reduction in the size of the anti-condensation mirror. Moreover, there is no possibility that localized overheat causes a fire.

Japanese Publication for Unexamined Utility Model Application No. 108154/1989 discloses such a conventional-type anti-condensation mirror. This anti-condensation mirror is constructed by attaching a heater cable having a positive temperature coefficient of resistance to the periphery of the mirror and forming on the rear surface of the mirror a heat-transfer layer in contact with the heater. U.S. Pat. No. 4,933,533 also discloses a conventional-type anti-condensation mirror. This anti-condensation mirror is constructed by mounting a heating cable element on the rear surface of the mirror. The heating cable element is formed by covering a resin containing a carbon having a positive temperature coefficient of resistance with a polyvinyl chloride.

Furthermore, Japanese Publication for Unexamined Utility Model Application No. 65497/1973 also discloses such an anti-condensation mirror. This anti-condensation mirror is constructed as follows. An electrical conductive board, an electrical insulating substrate, an electrical conductive board and a thermal insulating board are mounted in this order on the rear surface of the mirror with or without a heat transfer board thereon. A PTC thermistor is inserted into each of a plurality through holes formed in the insulating substrate. The electrodes on both surfaces of the PTC thermistor are connected to both the conductive boards, so that electricity is conducted to the PTC thermistor through the conductive boards.

With this structure, in order to efficiently conduct the heat produced by the PTC thermistor to the mirror, it is necessary to provide a heat transfer board between the mirror and the PTC thermistor.

However, with the structure disclosed in the above Japanese Unexamined Utility Model Application No. 108154/1989, since the cable heater is attached to the periphery of the mirror, the anti-condensation effects are produced from the periphery. Consequently, if an anti-condensation mirror incorporates a large-sized mirror, it takes a longer time for a central area that usually requires anti-condensation effects to receive the effects.

With the structure disclosed in U.S. Pat. No. 4,933,533, the heating cable elements are pressed against the mirror by a plastic supporting member in order to bring the heating cable elements into contact directly with the rear surface of the mirror. However, as is disclosed in the same document, it is extremely difficult to attach the heating cable element of a considerably long length of 13.5 m to the mirror by evenly pressing it against the mirror. Moreover, since a space is formed between the mirror and the supporting member, it is difficult to efficiently and evenly conduct the heat from by the heating cable element to the mirror.

On the other hand, with the structure disclosed in the above Japanese Unexamined Utility Model Application No. 65497/1973, it is possible to solve the problems that Japanese Utility Model Application No. 108154/1989 and U.S. Pat. No. 4,933,533 have. More specifically, with this structure, since the PTC thermistor is mounted through the heat transfer and electrical conductive boards on a desired area of the rear surface of the mirror, it is possible to produce anti-condensation effects on the desired area of the mirror with a shorter time. However, since the heat transfer board, electrical conductive board, electrical insulating substrate, electrical conductive board and thermal insulating board are mounted on the rear surface of the mirror, the anti-condensation mirror has an increased thickness. This also causes increases in the size and weight of the anti-condensation mirror. In addition, since this anti-condensation mirror does not have an appropriate insulation structure, currents may leak.

Finally, each of the heating elements disclosed in the above-mentioned documents are designed without much considering the water vapor-proof properties of the anti-condensation mirrors when installed in a bathroom for example. With their structures, it is difficult to water and vapor-proof them. Therefore, when installing these anti-condensation mirrors in the bathroom, a voltage of commercial power supply can not be directly applied to the heating elements due to safety reasons. Namely, it is necessary to provide a transformer to lower the value of voltage of the power supply, for example, to a value not greater than 24 V, or to ask a specialized builder to install these anti-condensation mirrors. Thus, these structures result in increased costs and complicated handling of the anti-condensation mirrors.

SUMMARY OF THE INVENTION

An object of the present invention is to provide a heater with a reduced thickness capable of efficiently conducting the heat produced by a heating element to an object to be heated.

In order to achieve the above object, a heater of the present invention at least includes:

(1) a heating element made of a thermistor having a positive temperature coefficient of resistance;
(2) electrodes formed on upper and lower surfaces of the heating element;
(3) a pair of flat metallic terminals electrically connected to the electrodes;
(4) a pair of feeders electrically connected to the inner surfaces of the metallic terminals that face each other; and
(5) an electrical insulating cover member for covering exposed portions of the heating element, the electrodes and of the metallic terminals, and the connections between the metallic terminals and the feeders so as to insulate them from outside.

With this structure, since the pair of feeders for feeding electricity to the heating element are connected to the inner surfaces of the metallic terminals, no bumps are produced in the outer surfaces of the metallic terminals even when the feeders are soldered to the metallic terminals. Accordingly, there is no need to increase the thickness of the insulating cover member at the outer surfaces of the metallic terminals to cover up such bumps. As a result, it is possible to reduce the thickness of the heater, and to improve the efficiency of the heat transfer from the heating element to a heated object when the heater is mounted on the heated object. Namely, the heater of the present invention is capable of efficiently heating the heated object.

Another object of the present invention is to provide a simplified manufacturing method of the heater by simplifying the process of covering a heating unit with the electrical insulating cover member.

In order to achieve the above object, a method of manufacturing the heater of the present invention at least includes the steps of:

(1) forming a heating unit by connecting a flat metallic terminal to each of electrodes formed on upper and lower surfaces of a flat heating element made of a thermistor having a positive temperature coefficient of resistance and by connecting feeders to the metallic terminals;
(2) disposing the heating unit at a predetermined position on a substrate of an electrical insulating material; and
(3) sealing exposed portions of the heating unit in the electrical insulating cover by injection-molding the insulating material after disposing the substrate in a mold.

With this method, the heating unit of the heater is covered with the insulating cover member by locating the heating unit at a predetermined position on the substrate, sealing exposed portions of the heating unit in the insulating cover by injection-molding the insulating material after disposing the substrate in the mold. Therefore, there is no need to perform minute work including locating the heating unit in the proper position on the substrate, pulling the lead wires from the substrate and securing the lead wires, thereby allowing the heater to be more easily manufactured.

Still another object of the present invention is to provide an anti-condensation mirror with reduced thickness and weight and good insulation structure, which allows an improvement of a heat transfer from a heating element to a mirror, easy handling during installation, and a reduction in costs including the cost for the installation.

In order to achieve the above object, an anti-condensation mirror of the present invention at least includes:

(1) a mirror;
(2) a heat transfer plate closely fastened to the rear surface of the mirror; and
(3) a plurality of heaters covered with an electrical insulating cover member and mounted on the rear surface of the heat transfer plate, each of the heaters incorporating a flat heating element made of a thermistor having a positive temperature coefficient of resistance.

With this structure, since the heater incorporating the heating element is covered with the electrical insulating cover material, it has good vapor-proof quality. The mirror is heated by a plurality of the heaters mounted on the rear surface of the heat transfer plate which is closely mounted on the rear surface of the mirror. Thus, the anti-condensation mirror is well insulated. In addition, since the heater uses the heating element made of a PTC thermistor as a heat source and has self-controlling temperature characteristics, there is no need to incorporate circuits for controlling the heat of a uniform temperature and for preventing overheating. This makes it possible to apply a voltage of the commercial power supply directly to the heater without reducing the value of the voltage. Consequently, the anti-condensation mirror is more easily handled, for example, during installation, and the costs including the cost for the installation are decreased.

Moreover, the anti-condensation mirror is constructed by a plurality of the heaters incorporating the heating element, mounted on the rear surface of the heat transfer plate which is fastened to the rear surface of the mirror. Such a simplified structure allows a reduction in the thickness and weight of the anti-condensation mirror, and an improvement of the heat transfer from the heating element to the mirror.

In order to achieve the above object, alternative anti-condensation mirror of the present invention at least includes:

(1) a mirror;
(2) a heat transfer plate closely attached to the rear surface of the mirror;
(3) a plurality of heaters covered with an electrical insulating material and mounted on the rear surface of the heat transfer plate, each of the heaters incorporating a flat heating element made of a PTC thermistor; and
(4) a junction member mounted on the rear surface of the heat transfer plate, the junction member having therein a connection area where the feeders of the heaters and a power cord are connected, the junction member covering the connections between the feeders and the power cord.

Like the above-mentioned anti-condensation mirror, this anti-condensation mirror achieves the above object by means of (1), (2) and (3).

With this structure, since the power cord and the feeders of the heaters mounted on the rear surface of the heat transfer plate are connected with the junction member covering the connections of the power code and the feeders, the power cord and the feeders are more easily connected compared to the case where the junction member is not used. Moreover, this structure enables not only a reduction in the length of the feeder, but also the lengths of the feeders from the center of the junction member to the heater to be substantially uniform, thereby facilitating the manufacture of the heater. Furthermore, the connections between the feeders and the power cord are easily waterproofed, if needed, by applying waterproof treatment to the junction member. Additionally, this structure prevents the feeders from getting loosened and caught in other members.

In order to achieve the above object, still alternative anti-condensation mirror of the present invention at least includes:

(1) a mirror;

(2) a heat transfer plate mounted on the rear surface of the mirror;

(3) a plurality of heaters covered with an electrical insulating cover member and mounted on the rear surface of the heat transfer plate, each of the heaters incorporating a flat heating element made of a PTC thermistor; and (4) a fixture for closely fastening the mirror to the rear surface of the heat transfer plate, the fixture having a base member attached to the rear surface of the mirror and a fastening member of a resilient material, the fastening member pressing the heat transfer plate against the mirror by engaging with the base member.

Like the above-mentioned anti-condensation mirrors, this anti-condensation mirror achieves the above object by means of (1), (2) and (3).

With this structure, the heat transfer plate is fastened to the rear surface of the mirror by the fixture, i.e., the base member mounted on the rear surface of the mirror and the fastening member of resilient material which engages with the base member. Therefore, if the mirror and the heat transfer plate expand, they slide suitably relative to each other. This arrangement prevents the mirror from warping due to a difference in linear expansion coefficient between the mirror and the heat transfer plate. Moreover, the heat transfer plate is fastened by engaging the base member with the fastening member after placing the heat transfer plate on a predetermined position of the rear surface of the mirror. Thus, the heat transfer plate is located on the predetermined position of the mirror without making the heat transfer plate slide over the mirror, preventing the mirror from being scratched. Furthermore, since the heat transfer plate is fastened to the rear surface of the mirror by engaging the fastening member of resilient material with the base member, the heat transfer plate is easily mounted on the mirror. For instance, in comparison to the mounting of the heat transfer plate to the mirror with an adhesive agent, the heat transfer plate is easily removed from the mirror when, for example, replacing the heater.

For a fuller understanding of the nature and advantages of the invention, reference should be made to the ensuing detailed description taken in conjunction with the accompanying drawings.

DESCRIPTION OF THE PREFERRED EMBODIMENTS

[EMBODIMENT 1]

The following description discusses one preferred embodiment of the present invention with reference to FIGS. 1 through 8.

Figure 1:
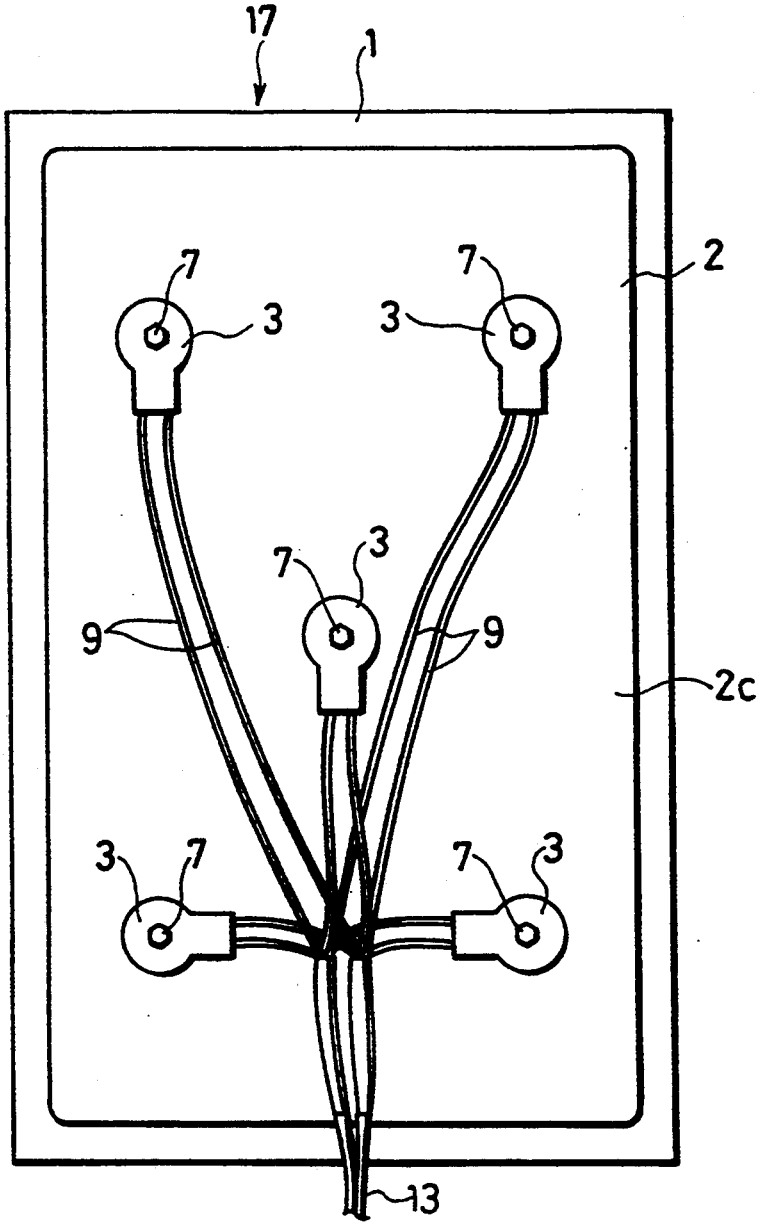
FIG. 1 is a rear view of an anti-condensation mirror of the present invention.

As illustrated in FIG. 1, an anti-condensation mirror 17 of this embodiment is formed by fixing a heat transfer plate 2 to a rear surface of a rectangular mirror 1 with, for example, an adhesive agent. A plurality of heaters 3 are mounted at predetermined intervals on a rear surface 2*c* of the heat transfer plate 2. Each of the heaters 3 includes a heating element 4 shown in FIGS. 3 and 4.

The heat transfer plate 2 is made of a metal plate with a high thermal conductivity, such as an aluminum plate, and is rectangular in shape and smaller than the mirror 1. The heat transfer plate 2 is provided with five holes 2*a*, shown in FIG. 2, for the installation of the heaters 3. One of the installation holes 2*a* is formed at the center of the heat transfer plate 2 and the other are formed at four diagonal locations separated by a predetermined distance from the center.

The heaters 3 are fixed to the heat transfer plate 2 by inserting flat-head screws 6 into the installation holes 2*a* and screwing nuts 7 on the screws 6. The configuration of the installation holes 2*a* are determined so that a head 6*a* of the flat-head screw 6 fits into the installation hole 2*a*. More specifically, the installation hole 2*a* has a cylindrical hollow section extending a predetermined distance from the rear surface 2*c* and a flaring section whose diameter increases gradually toward the front surface 2*b*. Thus, the front surface 2*b* of the heat transfer plate 2 to be attached to the rear surface of the mirror 1 is flat. The configuration and dimensions of the installation holes 2*a* are not strictly restricted if they match the configuration and dimensions of the flat-head screws 6.

Figure 3:
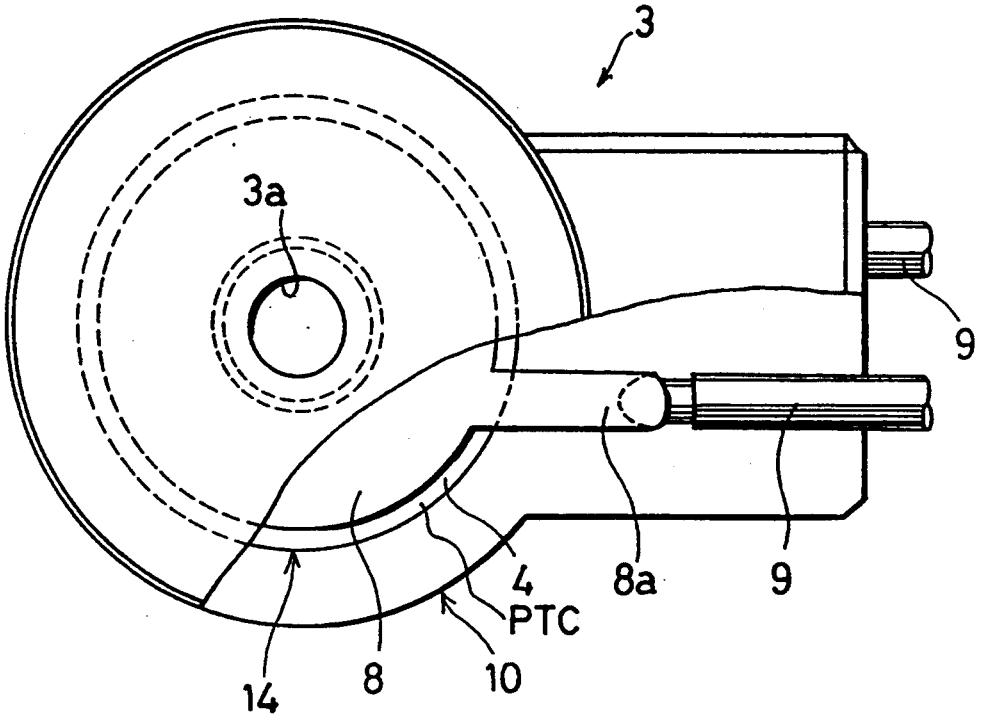
FIG. 3 is a partially exploded schematic front view of the heater.
Figure 4:
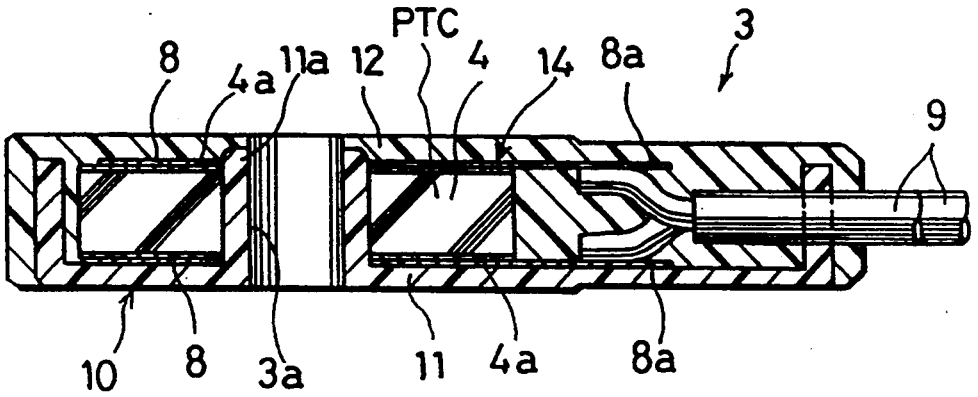
FIG. 4 is a sectional view of the heater.

As illustrated in FIGS. 3 and 4, each of the heaters 3 includes a heating element 4, metallic terminals 8, lead wires 9 as feeders, and an insulating case 10 as an electrical insulating cover member.

The heating element 4 has a positive temperature coefficient of resistance and is formed by a PTC thermistor that is produced from semiconductor ceramics of a barium titanate system comprising barium titanate doped with a small amount of oxides of rare earth elements such as La and Y, and oxides of Nb and Bi. The PTC thermistor has low resistance at temperatures from room temperature to Curie temperature Tc (resistance transition temperature), and the resistance abruptly increases above the Curie temperature Tc. With this characteristic, when a voltage is applied to the heating element 4, the heating element 4 draws high currents initially as the resistance is low at low temperatures, resulting in an increased consumption of electricity and a rapid temperature rise. Then, when the temperature of the heating element 4 exceeds the Curie temperature Tc, the resistance increases rapidly, thereby declining the consumption of electricity significantly. Thus, the temperature of the heating element 4 rises only up to a certain temperature and is stably kept at that level. Namely, the heating element 4 has self-controlling temperature characteristics. The Curie temperature Tc is set to an arbitrary temperature between about 30° and 270° C. by changing the composition of material forming the heating element 4. For example, if a part of the barium in barium titanate is replaced with Pb, the Curie temperature Tc shifts from the normal Curie point of around 120° C. to a higher temperature. On the other hand, if a part of the barium is replaced with Sr, the Curie temperature Tc shifts to a lower temperature. With this heating element 4, the Curie temperature Tc is determined by considering the working condition, safety and saving of electricity of the heaters 3. With this arrangement, surface temperatures which are effective to prevent condensation from forming on the mirror 1 are obtained.

Figure 5:
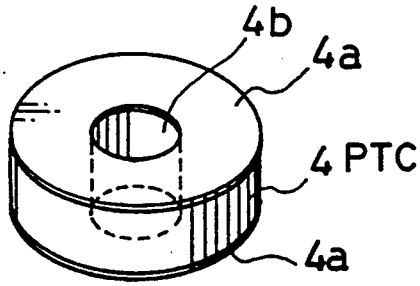
FIGS. 5(*a*) is a perspective view illustrating the manufacturing process of the heater, particularly, the step of forming electrodes on a heating element, FIG. 5(*b*) is a perspective view illustrating the step of connecting lead wires to metallic terminals and the step of mounting the metallic terminals on the electrodes, and FIG. 5(*c*) is a perspective view illustrating a heating unit obtained after the step of FIG. 5(*b*).
Figure 5:
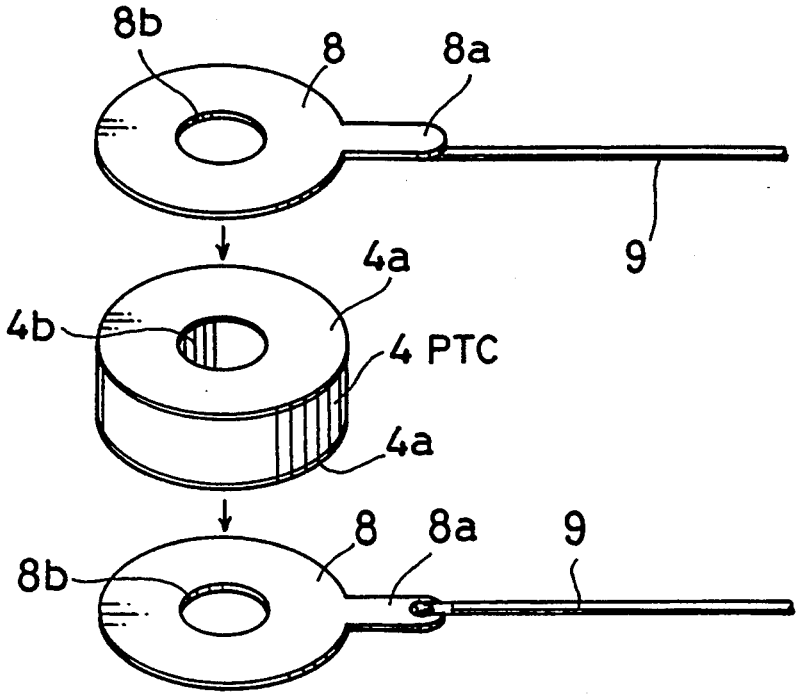
Figure 5:
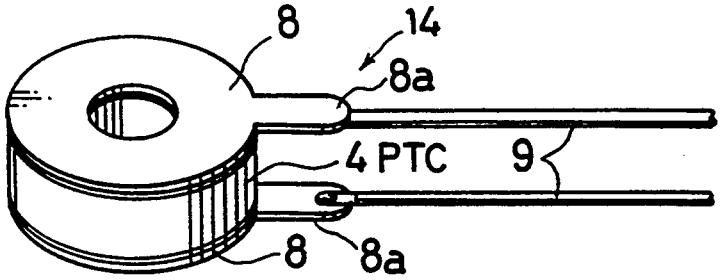

As illustrated in FIG. 5(*a*), the heating element 4 has a rather flat cylindrical shape. Electrodes 4*a* are formed on the top and bottom surfaces of the heating element 4 by applying thereto a silver coating for example. A locating hole 4*b* is formed at the center of the heating element 4 so that it passes through the top and bottom surfaces.

As illustrated in FIGS. 5(*b*) and 5(*c*), each of the metallic terminals 8 is formed in the shape of a flat plate with a diameter substantially equal to the diameter of the heating element 4, and has at the center a locating hole 8*b* whose diameter is substantially equal to the diameter of the locating hole 4*b* of the heating element 4. The metallic terminal 8 is provided with a feeding point 8*a* to which the lead wire 9 is connected. The feeding points 8*a* are parallel but out of alignment with each other, and extend in a direction in which the lead wires 9 are inserted.

The metallic terminal 8 and the heating element 4 are electrically connected by bonding the electrode 4*a* and the metallic terminal 8 together with, for example, an epoxy/silver mixed conductive adhesive agent such as DEMETRON 6290-0343 manufactured by Degussa AG. The lead wires 9 are soldered to inner surfaces of the feeding points 8*a* that face each other. In this case, due to the positional relation between the feeding points 8*a*, one of the lead wires 9 is connected to one of the metallic terminals 8 at a first position located on one side of a plane perpendicular to the electrodes 4*a* and the other lead wire 9 is connected to the other metallic terminal 8 at a second position located on the other side of the plane. This structure prevents the lead wires 9 from causing an increase in the thickness of the heating element 4. As illustrated in FIG. 4, the lead wires 9 are pulled from the electrical insulating case 10 so that they are parallel to a surface of the insulating case 10 to be mounted on the heated object and a distance between the mounting surface and each of the lead wires 9 becomes equal. The heating element 4, the metallic terminals 8 and the lead wires 9 form a heating unit 14 as shown in FIG. 5(*c*).

For example, the insulating case 10 is formed by an electrical insulating thermoplastic such as 6-nylon, and includes a base section 11 and a cover section 12 as a cover member as shown in FIG. 4. The insulating case 10 covers and seals the heating unit 14, and has a fixing hole 3*a* at the center which is used when fixing the heater 3 with a screw to the heated object. The insulating case 10 covers the ends of the lead wires 9 connected to the metallic terminals 8 so as to prevent disconnection of the lead wires 9 when a dynamic load is applied to the soldered connections of the lead wires 9 and the feeding points 8*a*.

For example, the base section 11 and the cover section 12 of the insulating case 10 are formed as a single piece through the following process. Firstly, the heating unit 14 is placed in the injection-molded base section 11. Then, after placing the base section 11 with the heating unit 14 thereon in a mold, plastics as an electrical insulating material is injection-molded to give the cover section 12. With this process, the entire heating unit 14 except the open ends of the lead wires 9 is fixed and sealed in the insulating case 10.

The base section 11 has a raised portion 11*a* formed at a portion corresponding to the periphery of the fixing hole 3*a*. When the heating unit 14 is placed on the base section 11, the raised portion 11*a* fits into the locating hole 4*b* of the heating element 4 and the locating holes 8*b* of the metallic terminals 8, so that the heating unit 14 is held in proper position. Namely, the heating unit 14 is positioned in an area of the base section 11 around the raised portion 11*a*.

The requirements to be satisfied by the insulating case 10 are a low shrinkage rate against heat, high thermal conductivity, high mechanical strength, resistance to the heated temperature of the heating element 4, waterproof quality impervious to moisture including water and vapor, airtight quality impervious to air, and well adhesiveness to the covering material of the lead wires 9. For instance, the insulating case 10 produced from a polymer alloy of nylon, polypropylene and glass fiber meets these requirements. It is also possible to use thermosetting plastics to form the insulating case 10.

A single insulating case 10 is constituted by the base section 11 and the cover section 12. It is desirable to form the base section 11 and the cover section 12 from the same or similar electrical insulating materials in order to achieve good affinity and an equal thermal expansion coefficient. However, considering thermal conductivity, the base section 11 having high thermal conductivity to the heated object and the cover member 12 radiating less heat into the air are more desirable. If the thermal conductivity is taken into consideration prior to the affinity and equal thermal expansion coefficient, a material having good thermal conductivity and electrical insulation, for example, the polymer alloy is used for the base section 11 and a material having relatively low thermal conductivity, for example, an epoxy resin is used for the cover section 12.

As illustrated in FIG. 1, the lead wires 9 connected to the heaters 3 are connected to a power cord 13. For example, the lead wires 9 are connected to an external power supply through the power cord 13.

With reference to this structure, the method of manufacturing the heaters 3 is explained below.

Firstly, the rather flat cylindrical heating element 4 shown in FIG. 5(*a*) is formed and sintered. Secondly, a silver coating is applied to the top and bottom surfaces of the heating element 4 and sintered to form the electrodes 4*a*.

Next, as shown in FIG. 5(*b*), the metallic terminals 8 are attached to the electrodes 4*a* with a conductive adhesive agent, and the lead wires 9 are soldered to the inner surfaces of the feeding points 8*a* of the metallic terminals 8. Or, the metallic terminals 8 are attached to the electrodes 4*a* with the conductive adhesive agent after soldering the lead wires 9 to the feeding points 8*a*. Consequently, the heating unit 14 shown in FIG. 5(*c*) is obtained.

Figure 6:
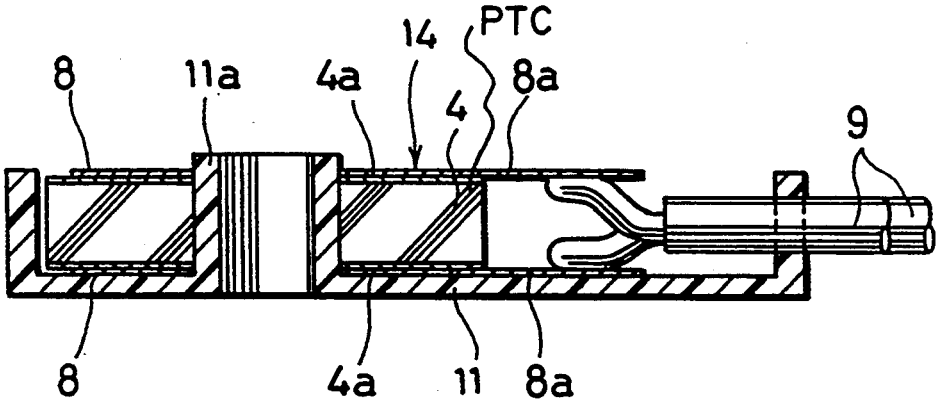
FIG. 6 is a vertical section illustrating the step of injection-molding the cover section of an insulating case in the manufacturing process of the heater, wherein the heating unit is mounted on the base section of the insulating case.

Then, as illustrated in FIG. 6, the heating unit 14 is placed on the injection-molded base section 11 of the insulating case 10. At this time, the heating unit 14 is positioned so that the raised portion 11*a* of the base section 11 fits into the locating hole 4*b* of the heating element 4 and the locating holes 8*b* of the metallic terminals 8.

Subsequently, the base section 11 is placed in a mold, and plastics is injection-molded to produce the cover section 12. Thus, the base section 11 and the cover section 12 of the insulating case 10 are formed as a single piece. With this arrangement, since the entire heating unit 14 except for the open ends of the lead wires 9 is thoroughly covered with and sealed in the insulating case 10, the heating unit 14 is insulated from outside.

As a result, the heaters 3 shown in FIGS. 3 and 4 are obtained. For example, it is possible to attach a plug to the ends of the lead wires 9 in order to more easily connect the lead wires 9 to the external power supply. Also, a female thread groove is formed in the fixing hole 3*a*, if needed.

In this embodiment, the metallic terminals 8 are attached to the electrodes 4*a* of the heating element 4 with the electrical conductive adhesive agent. Although attaching the metallic terminals 8 to the electrodes 4*a* with the conductive adhesive agent is easily performed, it limits the mass-production efficiency. The reasons for this is that it takes about one day to harden the conductive adhesive agent, and care is required to prevent the conductive adhesive agent from flowing over the side faces of the heating element 4 and causing the electrodes 4*a* having a short circuit.

Figure 32:
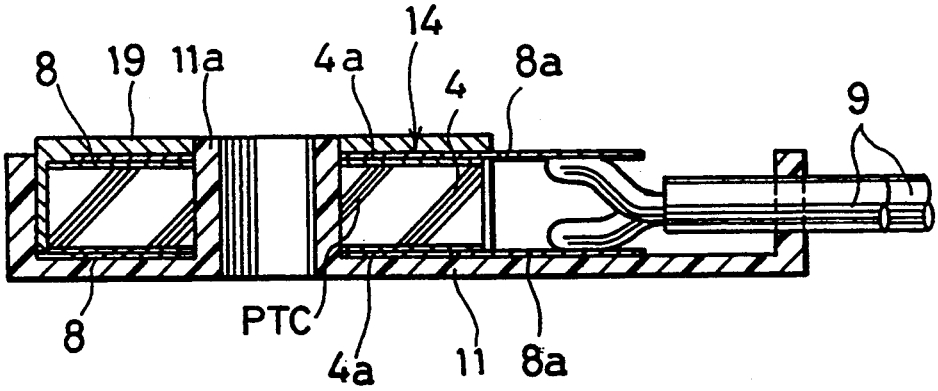
FIG. 32(*a*) is a vertical section of an alternative example of the heating unit mounted on the base section of the insulating case shown in FIG. 6, and FIG. 32(*b*) is a perspective view of a cap used when assembling the heating unit.
Figure 32:
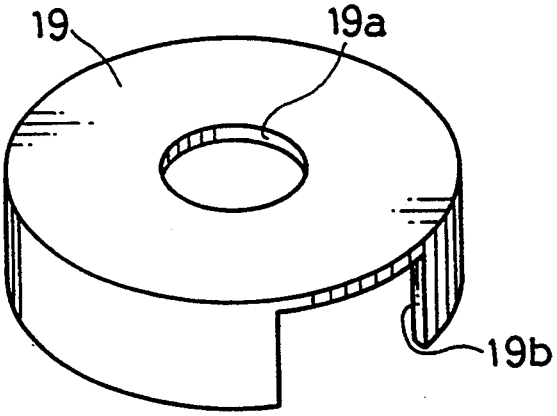

In order to further improve the efficiency of mass-production of the heater 3, it is desirable to put a cap 19 over the electrodes 4*a* and the metallic terminals 8 as shown in FIG. 32(*a*) instead of using the conductive adhesive agent. The cap 19 is formed by the electrical insulating material used for forming the insulating case 10. As illustrated in FIG. 32(*b*), a locating hole 19*a* is formed at the center of the upper surface of the cap 19 and a window 19*b* for allowing the feeding points 8 to protrude from the cap 19 is formed in a side face thereof. The diameter of the locating hole 19*a* is substantially equal to the major diameter of the raised portion 11*a*. The width of the window 19*b* corresponds to the horizontal distance between the feeding points 8*a*, and the height of the window 19*b* substantially corresponds to the total amount of the thickness of the heating unit 4 and the thickness of one metallic terminal 8.

One example of design dimensions of the heater 3 is given below. The thicknesses of the base plate of the base section 11, the metallic terminal 8, the heating element 4, top plate of the cap 19 and the top plate of the cover section 12 are 1.0 mm, 0.2 mm, 2.5 mm, 0.5 mm and 0.5mm, respectively. Namely, the heater 3 has a thickness of 4.9 mm. In the case where the metallic terminals 8 are attached to the electrodes 4*a* with the conductive adhesive agent without using the cap 19, the thickness of the top plate of the cover section 12 is set to 1.0 mm. The major diameter of the heating element 4 is set to 15 mm for example.

The manufacture of the heater 3 with the cap 19 is discussed below. Firstly, the lower metallic terminal 8, the heating element 4 with electrodes 4*a*, and the upper metallic terminal 8 are inserted in this order into the base section 11 of the insulating case 10. Secondly, in the step of soldering, the lead wires 9 are soldered to the inner surfaces of the feeding points 8*a* that face each other. However, it is not necessary to perform soldering after the insertion of the electrodes 4*a* and the metallic terminals 8 into the base section 11, it may be performed before or upon the insertion of each metallic terminal 8*a* into the base section 11. Then, the cap 19 is placed over the metallic plate 8 while locating the locating hole 19*a* and the window 19*b* of the cap 19 on the corresponding positions of the raised portion 11*a* and the feeding points 8*a* so as to complete the heating unit 14. Subsequently, injection-molding is performed in the above-mentioned manner.

By assembling the heating unit 14 with the cap 19 instead of the conductive adhesive agent, the time taken for hardening the conductive adhesive agent is sawed and the possibility that the flowing of the conductive adhesive agent causes the electrodes 4*a* to have a short circuit is eliminated. Thus, if the caps 19 are prepared, the efficiency of mass production of the heater 3 improves.

The following description discusses a method of manufacturing the anti-condensation mirror 17 having the heaters 3.

Figure 2:
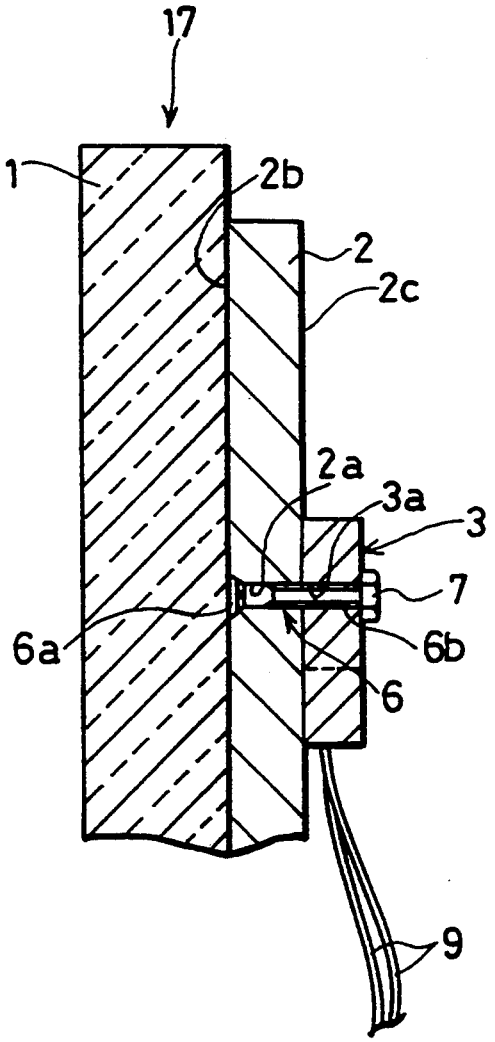
FIG. 2 is a sectional view of essential components illustrating an assembly structure of a heater in the anti-condensation mirror shown in FIG. 1.

In manufacturing the anti-condensation mirror 17, the heaters 3 are first mounted on the heat transfer plate 2. At this time, as illustrated in FIG. 2, the flat-head screw 6 is inserted into the installation hole 2*a* from the front surface 2*b* of the heat transfer plate 2. And, the heater 3 is positioned so that the thread section. 6*b* of the flat-head screw 6 protruding through the installation hole 2*a* from the rear surface 2*c* fits into the fixing hole 3*a* of the heater 3.

Then, the nut 7 is fastened on the flat-head screw 6 so as to stick a surface of the heater 3 closely to the rear surface 2*c* of the heat transfer plate 2. Since the maximum diameter of the head 6*a* of the flat-head screw 6 is equal to the maximum diameter of the flaring section of the installation hole 2*a*, the head 6*a* can never protrude from the front surface 2*b* of the heat transfer plate 2. When fastening the flat-head screw 6 with the nut 7, a washer or spring washer is placed between the heater 3 and the nut 7, if necessary.

The manufacture of the anti-condensation mirror 17 is complete by sticking the heat transfer plate 2 having the heaters 3 to a predetermined location of the rear surface of the mirror 1.

In the heaters 3 of this embodiment, as described above, since the lead wires 9 are connected to the inner surfaces of the feeding points 8*a* of the metallic terminals 8, the connections of the lead wires 9 do not produce any bumps on the outer surfaces of the metallic terminals 8. Accordingly, there is no need to increase the thickness of the insulating case 10 at the outer surfaces of the metallic terminals 8 to cover up the bumps. Namely, it is possible to form the thin insulating case 10. Moreover, this structure enables not only a reduction in the thickness of the heaters 3, but also, when the heaters 3 are mounted on a heated object such as the heat transfer plate 2, the heat from the heating element 4 to be efficiently conducted to the heated object.

Furthermore, the fixing hole 3*a* formed at the center of the heater 3 enables the heater 3 to be screwed to the heated object by fitting a screw into the fixing hole 3*a*. This makes it possible to stick the upper or lower surface of the heater 3 closely to the heated object, thereby allowing the heat from the heating element 4 to be efficiently conducted to the heated object.

Also, since the metallic terminal 8 is formed in the shape of a flat plate, the insulating case 10 of a reduced thickness and an improved thermal conductivity is achieved.

Additionally, since the heating unit 14 including the heating element 4 is covered with the insulating case 10 and electrically insulated from the heated object, it is possible to attach the heaters 3 closely to the heated object of metal for example. And, since the insulating case 10 is waterproof, the heaters 3 may be used to heat and warm liquid such as water and milk. If the insulating case 10 is formed by a silicon resin, the heaters 3 are also flameproof.

In this embodiment, each heater 3 includes one heating element 4. However, the number of the heating element 4 is not restricted to one, and it is possible to use more than one heating element 4. The configuration of the heaters 3 is not restricted to cylindrical shape, and the heaters 3 can be formed in various shapes, for example, into a polygonal plate. Also, the configuration of the heating element 4 is not restricted to a rather flat cylindrical shape, and it may be formed in the shape of a disk or a rectangular parallelpiped shape. The number and the position of the heating element 4 and of the fixing hole 3*a* in the heater 3 are not restricted to those described in the embodiment, and they are changeable according to the size of the heater 3 and the type of assembly of the heaters 3 and the heated object.

With the above method of manufacturing the heaters 3, the covering of the heating unit 14 with the insulating case 10 is carried out as follows. Firstly, the heating unit 14 is positioned such that the raised portion 11*a* of the base section 11 of the insulating case 10 fits into the locating hole 4*b* of the heating element 4 and the locating holes 8*b* of the metallic terminals 8. Then, after placing the base section 11 in a mold, the cover section 12 is injection-molded. Thus, the heating unit 14 is sealed in the insulating case 10. Unlike a conventional method, this method does not require complicated work including positioning the heating unit 14 in the base section 11, pulling the lead wires 9 from the heating unit 14 and fixing the lead wires 9, thereby facilitating the manufacture of the heaters 3. Besides, since the raised portion 11*a* of the heating unit 14 fits into the above-mentioned holes when the heating unit 14 is positioned on the base section 11, the heating element 4 is easily placed in proper position in the insulating case 10 to be injection-molded.

Moreover, since the heater 3 includes the heating element 4 as heating means formed by the PTC thermistor, when the temperature promptly rises to a predetermined temperature after conducting electricity, the heater 3 automatically keeps the temperature. Thus, in the anti-condensation mirror 17 having the heaters 3, the surface temperature of the mirror 1 quickly rises to a predetermined temperature and the anti-condensation effects are soon produced on the surface of the mirror 1.

In the anti-condensation mirror 17, since a plurality of the heaters 3 covered with the insulating case 10 for heating the mirror 1 are mounted on the rear surface of the heat exchange plate 2, the heaters 3 exhibit satisfactory resistance to moisture and water. With this structure, it is possible to apply a voltage of a commercial power supply to the heaters 3 without decreasing the value of voltage. Consequently, the anti-condensation mirror 17 is more easily handled during installation, and the costs including the cost for the installation thereof in the bath room are lowered.

In addition, the anti-condensation mirror 17 is constructed by mounting a plurality of flat-shaped heating elements 4 constituting the heaters 3 on the heat transfer plate 2 attached to the rear surface of the mirror 1. Such a simplified structure enables not only a reduction in the thickness and weight of the anti-condensation mirror 17, but also efficient conduction of the heat from the heating element 4 to the mirror 1.

As described above each of the heater 3 has the flat heating element 4 and the flat metallic terminals 8, and the lead wires 9 are connected to the inner surfaces of the metallic terminals 8. This arrangement allows a reduced thickness of the insulating case 10. Consequently, the anti-condensation mirror 17 has a reduced thickness and improved heat conduction between the heaters 3 and the mirror 1. For instance, even if the lead wires 9 are connected to the outer surfaces of the metallic terminals 8, it is still possible to reduce the thickness of the anti-condensation mirror 17 and to achieve satisfactory heat conduction between the heaters 3 and the mirror 1 because the heaters 3 includes the flat heating elements 4 and flat metallic terminals 8.

The anti-condensation mirror 17 is particularly useful in an environment such as a bathroom where the mirror 1 is susceptible to the formation of condensation due to high humidity. If the heat transfer plate 2 is mounted on an area of the rear surface of the mirror 1 corresponding to the face level of a person before the mirror 1 to produce the anti-condensation effects only on the area, it is especially convenient when having make-up.

Figure 7:
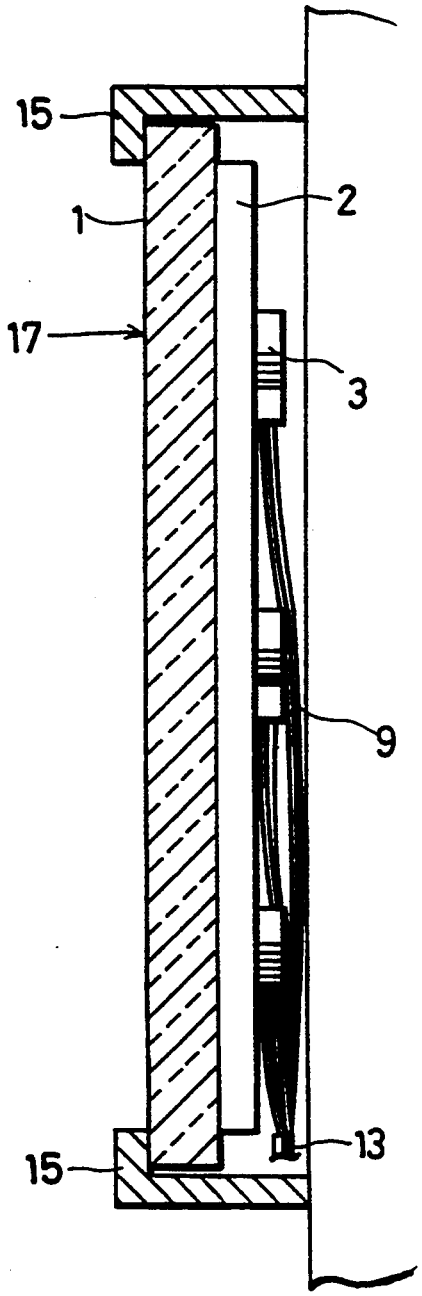
FIG. 7 is a schematic vertical section illustrating a type of installation of the anti-condensation mirror on the wall surface.

As for the installation of the anti-condensation mirror 17, for example, it is secured to the wall by making a recess in the wall and by fitting portions of the anti-condensation mirror 17 other than the mirror 1 into the recess. It is also possible to secure the anti-condensation mirror 17 by mounting fixtures 15 on the wall surface and supporting, for example, the top and bottom of the anti-condensation mirror 17 with the fixtures 15 as shown in FIG. 7. In this case, there is no need to make the recess in the wall surface, facilitating the installation of the anti-condensation mirror 17 on the wall.

A switch, not shown, of the heaters 3 is manually turned ON and OFF or it may be switched in an interlocking manner with the switching of the light in the bath room. It is also possible to install a moisture sensor in the bath room and control the conduction of electricity to the heater 3 by signals from the moisture sensor. More specifically, electricity is conducted to the heaters 3 when the moisture sensor senses humidity exceeding a predetermined level, while electricity is not conducted to the heaters 3 when it senses humidity lower than the predetermined level.

Figure 8:
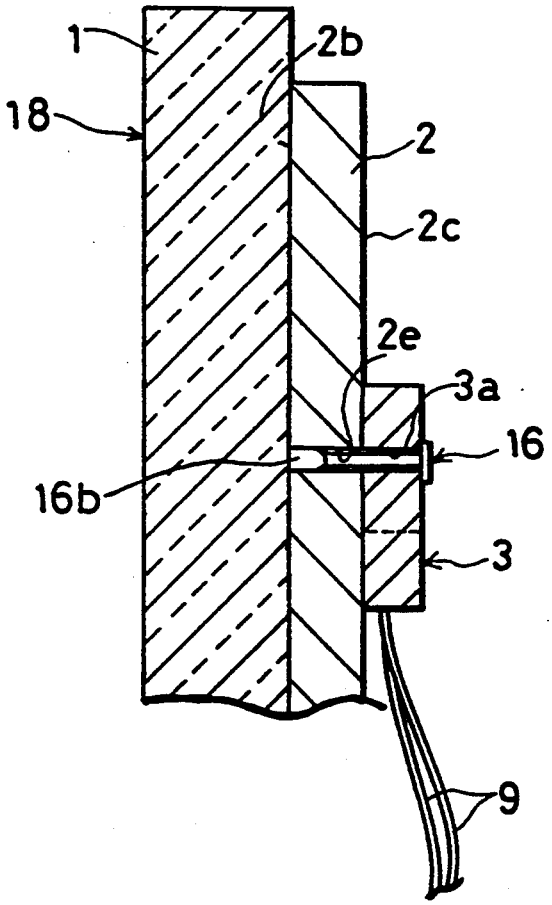
FIG. 8 is a vertical section of essential components illustrating alternative assembly structure of the heater shown in FIG. 2.

In this embodiment, the flat-head screw 6 and the nut 7 are used for mounting the heaters 3 on the heat transfer plate 2. However, it is also possible to mount the heaters 3 on the heat transfer plate 2 with a drivescrew 16 having a flat end **16*b* as illustrated in FIG. 8**.

The following description explains assembly of the heaters 3 to the heat transfer plate 2 with the drivescrew 16.

Firstly, the drivescrew 16 is inserted into the fixing hole **3*a* of the heater 3. Secondly, the end 16*b* of the drivescrew 16 protruding from the fixing hole 3*a* is driven from the rear surface 2*c* into an installation hole 2*e* in the cylindrical section formed in the heat transfer plate 2 so that a surface of the heater 3 sticks closely to the rear surface 2*c*. At this time, since the end 16*b* of the drivescrew 16 is flat, the front surface 2*b* of the heat transfer plate 2 becomes flat. Next, the heat transfer plate 2 having the heaters 3 thereon is mounted on a given position on the rear surface of the mirror 1 to complete the anti-condensation mirror 17 shown in FIG. 8. In this case, there is no need to to make the flaring section in the installation hole 2*e*, the thickness of the heat transfer plate 2 is further reduced. As a result, heat is more efficiently conducted from the heaters 3 to the mirror 1**.

In this embodiment, five heaters 3 are mounted on the heat transfer plate 2. However, the number of the heaters 3 is not restricted to five. Also, the positions of the heaters 3 with respect to the heat transfer plate 2 are not restricted to those described above and are changed suitably. Additionally, the heaters 3 are not necessarily fastened to the heat transfer plate 2 with screws, and they may be fastened with an adhesive agent. In this case, there is no need to form the fixing holes **3*a* in the heaters 3 and the locating holes 4*b* in the heating elements 4**.

Furthermore, it is not necessary to form the heat transfer plate 2 in the shape of a rectangle. The heat transfer plate 2 may be formed in various shapes, for example, disk and diamond. The size of the heat transfer plate 2 is also changed according to the size of the mirror 1.

[EMBODIMENT 2]

A second embodiment of the present invention is described below with reference to FIGS. 9 through 23. The members having the same function as in the above-mentioned embodiment are designated by the same cord and their description are omitted.

Figure 9:
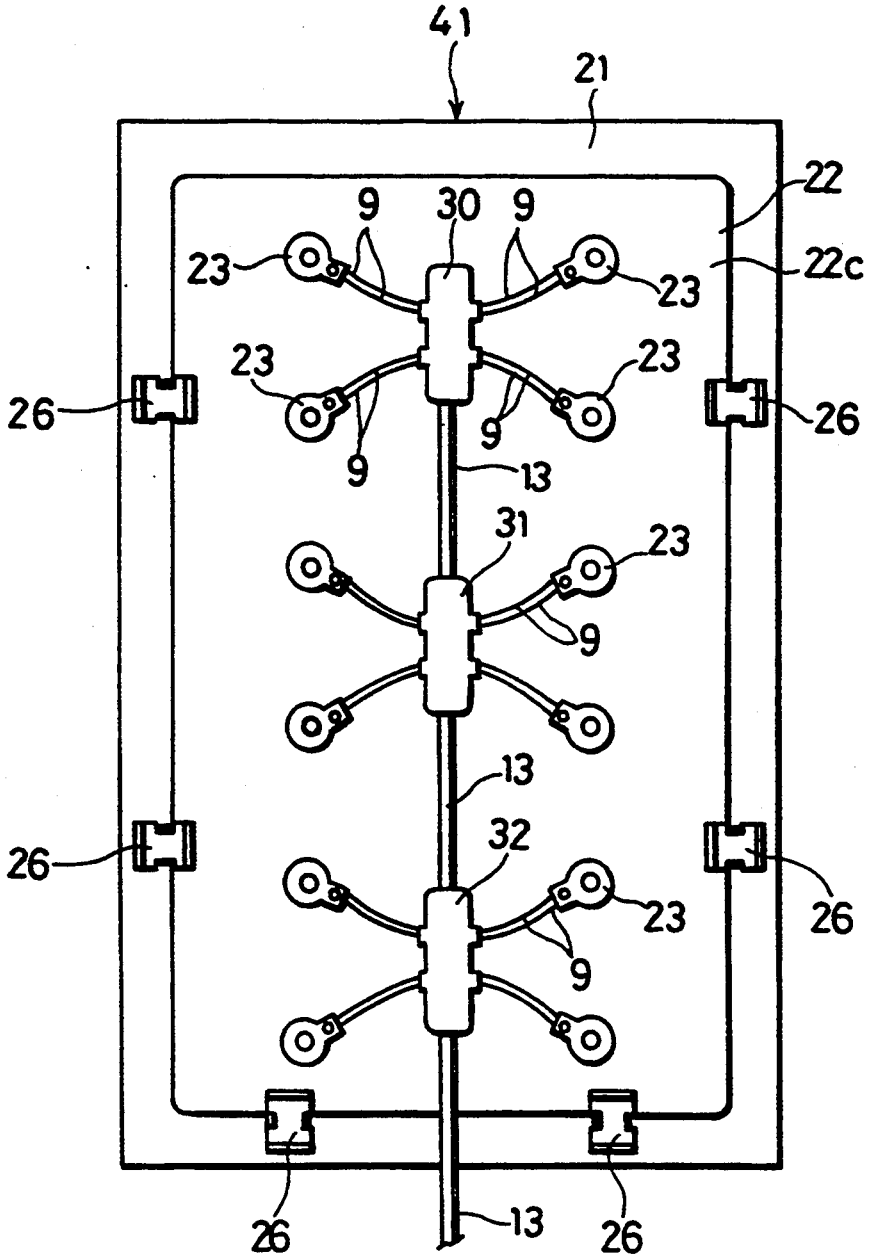
FIG. 9 is rear view illustrating alternative anti-condensation mirror of the present invention.

As illustrated in FIG. 9, an anti-condensation mirror 41 of this embodiment incorporates a mirror 21 of an area greater than that of the mirror 1 of the first embodiment. Fastened closely to the rear surface of the mirror 21 is a heat transfer plate 22 whose area is slightly smaller than that of the mirror 21. The heat transfer plate 22 and the above-mentioned heat transfer plate 2 are made of the same material. The heat transfer plate 22 is fastened with a plurality of fixtures 26 without using an adhesive agent. Twelve heaters 23 are mounted on a rear surface **22*c* of the heat transfer plate 22. Moreover, three junction members 30, 31 and 32 are mounted thereon at lower, center and upper locations. The junction members 30, 31 and 32 are long narrow pieces and disposed at substantially equal intervals on a vertical line passing through the center of the rear surface 22*c***.

Two heaters 23 are disposed on each of the right and left sides of the junction members 30, 31 and 32, respectively. Namely, four heaters 23 are provided in total for each of the junction members 30, 31, and 32. The heaters 23 are respectively connected to the corresponding junction members 30, 31 and 32 with the lead wires 9. And the power cord 13 is connected to the junction members 30, 31 and 32.

Figure 10:
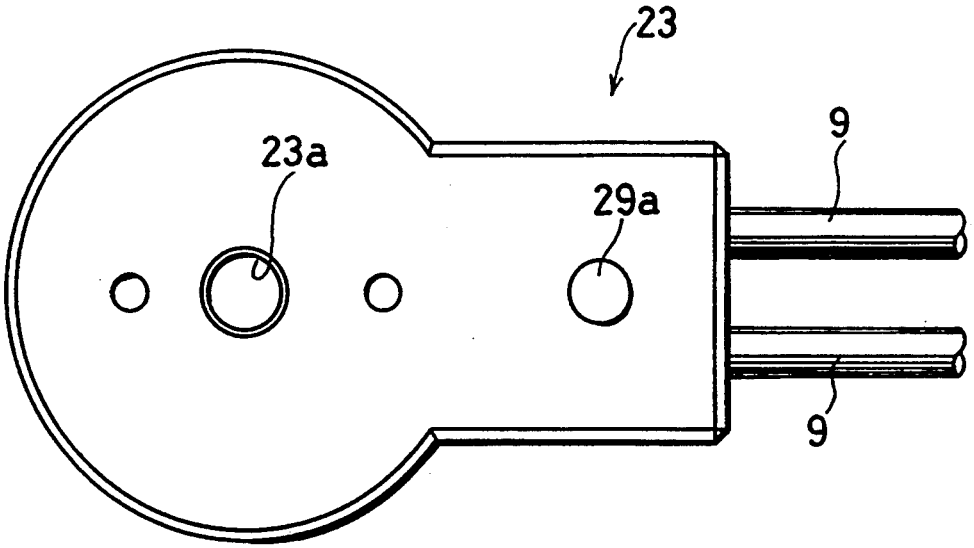
FIG. 10 is a front view of the heater shown in FIG. 9.
Figure 11:
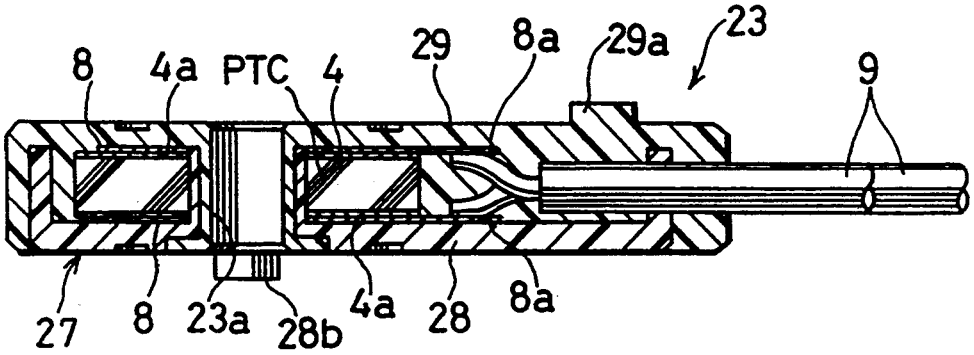
FIG. 11 is a vertical section of the heater.

As illustrated in FIGS. 10 and 11, the heater 23 is provided with an insulating case 27 instead of the insulating case 10 for the heater 3. Except for this difference, the structure of the heater 23 is the same as that of the heater 3. Namely, the heater 23 is formed by the heating element 4, the metallic terminals 8, the lead wires 9 as feeders, and the insulating case 27 as an electrical insulating cover member.

The insulating case 27 and the insulating case 10 are made of the same material. The insulating case 27 is formed by a base section 28 and an cover section 29 as a substrate, and has a fixing hole 23*a* at the center thereof. The fixing hole 23*a* is provided for screwing the heater 23 to the heat transfer plate 22.

Figure 12B:
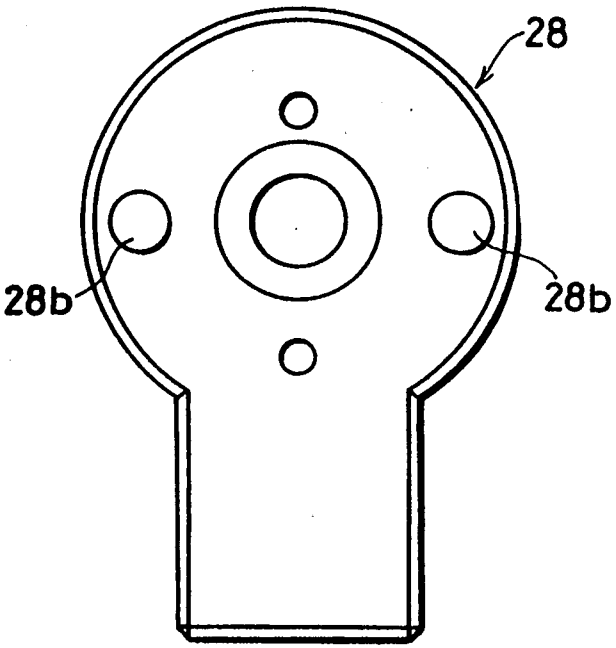
FIG. 12(*a*) is a front view of the base section of the insulating case shown in FIG. 11, FIG. 12(*b*) is a rear view thereof, and FIG. 12(*c*) is a bottom view thereof.
Figure 12A:
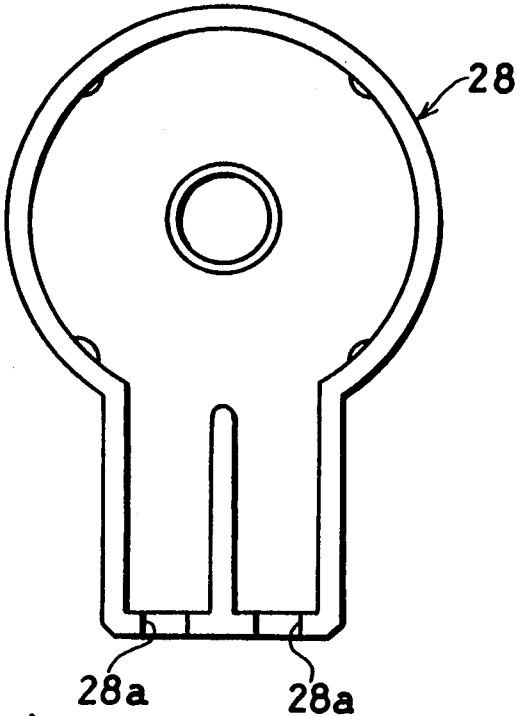
Figure 12C:
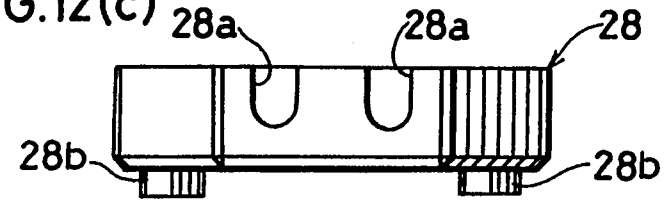

As shown in FIGS. 12(*a*) through 12(*c*), channels 28*a* are formed on a side of the base section 28 from which the lead wires 9 are inserted into the junction member. Also, two locating lugs 28*b* are formed on the floor of the base section 28 at locations corresponding to both sides of the fixing hole 23*a*. The locating lugs 28*b* are used for placing the insulating case 27 in proper position when mounting it on the heat transfer plate 22.

Figure 13:
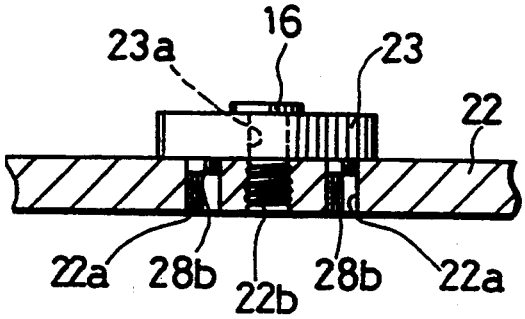
FIG. 13 is a vertical section of essential components illustrating an assembly structure of the heater.
Figure 14C:
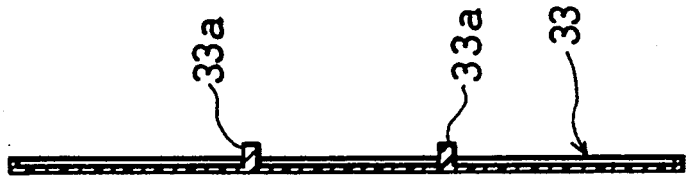
FIG. 14(*a*) is a side view of the lid of the upper junction member shown in FIG. 9, FIG. 14(*b*) is a front view thereof, FIG. 14(*c*) is a vertical section cut across line A—A of FIG. 14(*b*), and FIG. 14(*d*) is a bottom view thereof.
Figure 14B:
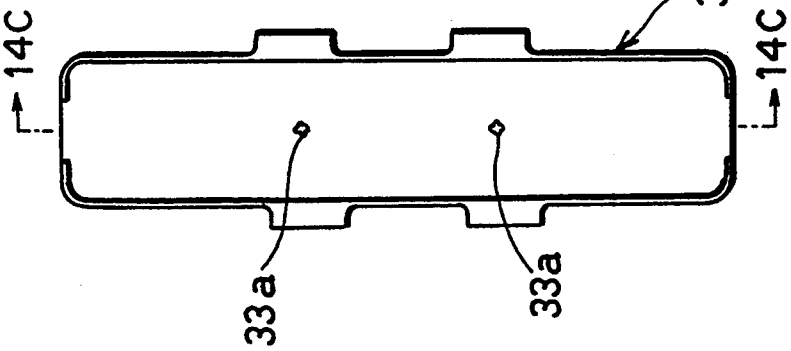
Figure 14D:
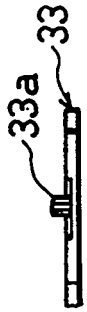
Figure 14A:
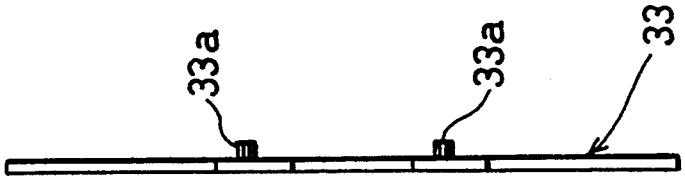

Meanwhile, as illustrated in FIGS. 10 and 11, a locating lug 29*a* is formed on a side of the cover section 29 from which the lead wires 9 are inserted. The locating lug 29*a* is provided to prevent the wrong side of the insulating case 27 from being attached to the heat transfer plate 22. With this arrangement, the base section 28 of the insulating case 27 is closely fastened to the heat transfer plate 22. Locating holes 22*a* corresponding to the locating lugs 28*b* are formed in the heat transfer plate 22 as shown in FIG. 13. The configuration, number and position of the locating lugs 28*b* and 29*a* are not restricted to those mentioned above and are changed suitably.

As shown in FIG. 13, the heater 23 is fastened with the drivescrew 16 to the heat transfer plate 22 having a threaded installation hole 22*b* into which the edge of the drivescrew 16 is inserted.

Figures 15A, 15B, 15C, 15D, 15E:
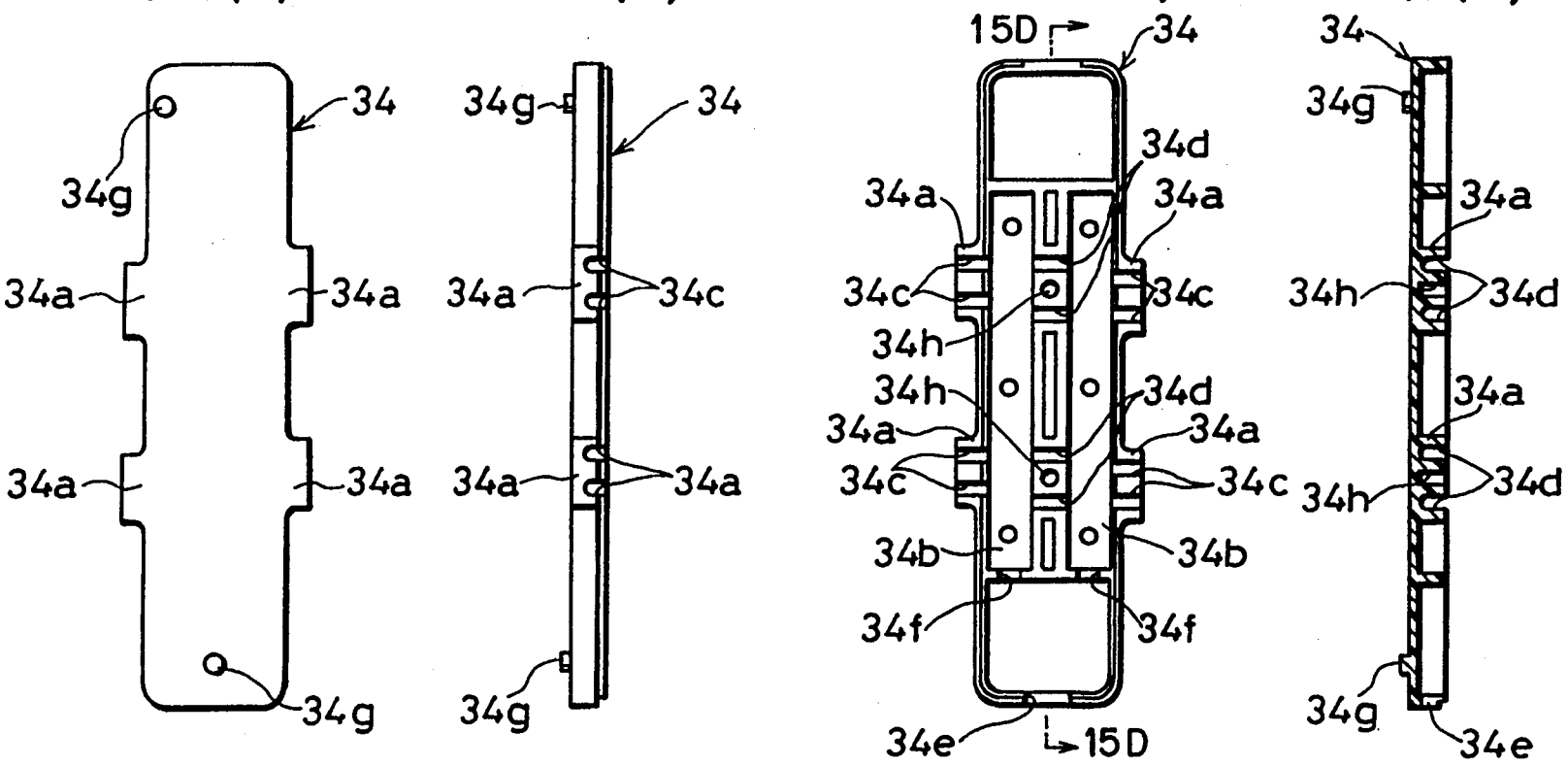
FIG. 15(*a*) is a rear view of the main body of the upper junction member shown in FIG. 9, FIG. 15(*b*) is a side view thereof, FIG. 15(*c*) is a front view thereof, FIG. 15(*d*) is a vertical section cut across line B—B of FIG. 15(*c*), and FIG. 15(*e*) is a bottom view thereof.

The upper junction member 30 is formed by a lid 33, shown in FIGS. 14(*a*) through 14(*d*), and a main body 34, shown in FIGS. 15(*a*) through 15(*d*).

Figure 16:
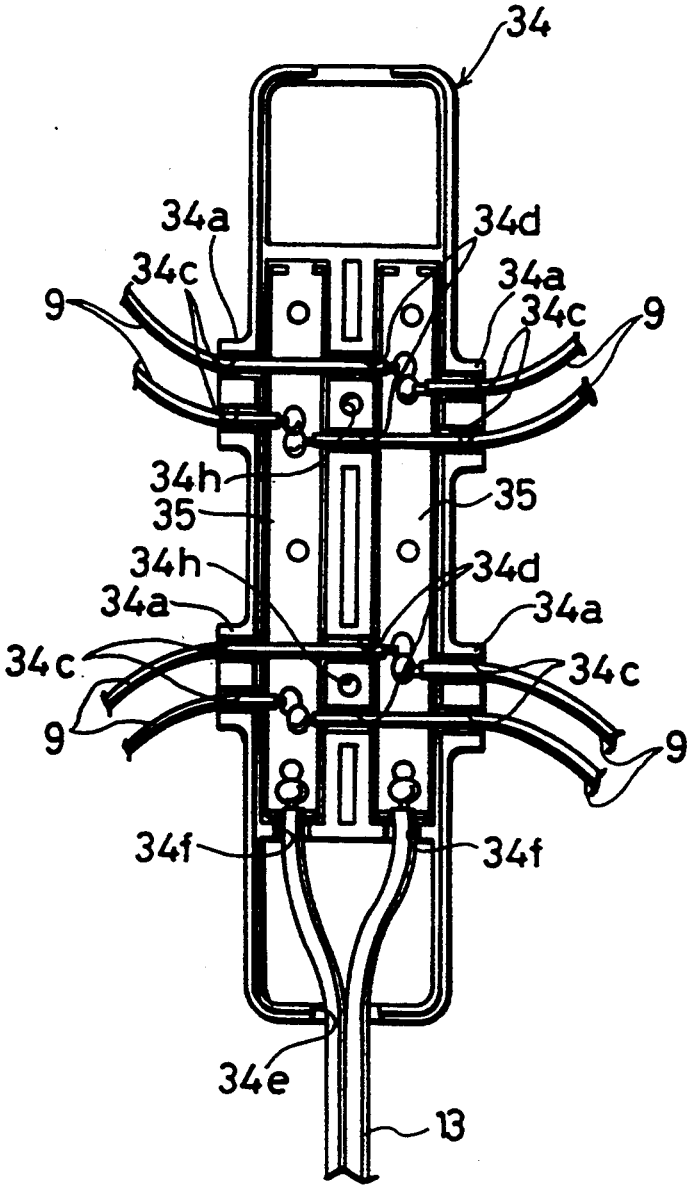
FIG. 16 is a front view illustrating the connections between the lead wires of the heaters and power cord and the main body of the upper junction member.
Figure 17:
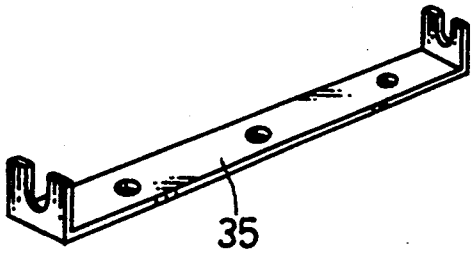
FIG. 17 is a perspective view illustrating a connecting terminal shown in FIG. 16.
Figure 18:
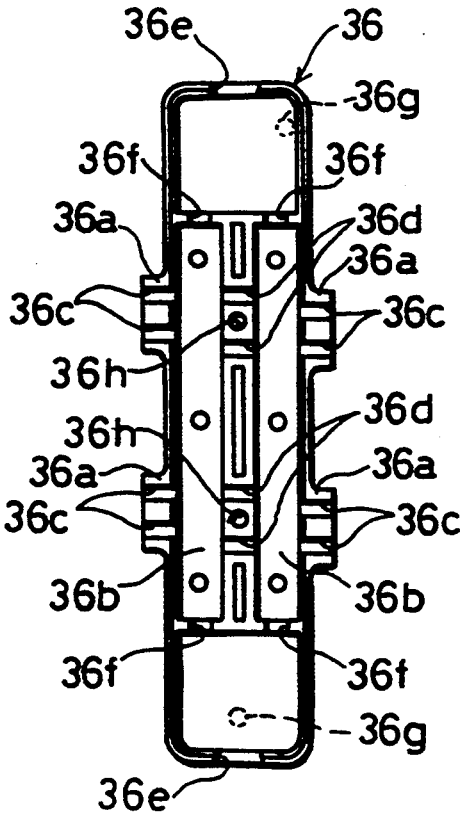
FIG. 18 is a front view of the main body of the middle junction member shown in FIG. 9.

The main body 34 is a narrow and shallow container having two lead-wire inserting section 34*a* at upper and lower locations on each side thereof for the lead wires 9. The lead-wire inserting sections 34*a* on one side of the main body 34 and the lead-wire inserting sections 34*a* on the other side thereof are formed on slightly different levels. The main body 34 has a right connecting-terminal mounting section 34*b* and a left connecting-terminal mounting section 34*b* which are separated by ribs. For example, a connecting terminal 35 of brass shown in FIGS. 16 and 17 is placed in each connecting-terminal mounting section 34*b*. Also, formed in the upper and lower portions of the ribs between the connecting-terminal mounting sections 34*b* are sockets 34h corresponding to lugs 33*a* of the lid 33 to be described later.

A pair of channels 34*c* are formed in each lead-wire inserting section 34*a*. Two pairs of channels 34*d* are formed in the ribs between the connecting-terminal mounting sections 34*b*. The upper channel 34*d* of each pair is formed to be level with the upper channel 34*c* of the corresponding left lead-wire inserting section 34*a* as shown in FIG. 15(*c*). On the other hand, the lower channel 34*d* of each pair is formed to be level with the lower channel 34*d* of the corresponding right lead-wire inserting section 34*a*. Formed at the lower end of the main body 34 of the upper junction 30 is a channel 34*e* for the power cord 13. Also, formed in the ribs separating the lower portions of the connecting-terminal mounting sections 34*b* are channels 34*f* for separately guiding the ends of the power cord 13 inserted into the main body 34 through the channel 34*e* to the connecting terminals 35.

Two locating lugs 34*g* are formed on the rear surface of the main body 34. These locating lugs 34*g* are used when mounting the main body 34 of the upper junction member 30 on the heat transfer plate 22. The heat transfer plate 22 has locating holes, not shown, corresponding to the locating lugs 34*g*. The position and number of the locating lugs 34*g* are changed suitably.

As illustrated in FIG. 16, the lead wires 9 of the heaters 23 and the power cord 13 are connected to the main body 34. In this figure, the upper lead wire 9 of each pair of the lead wires 9 inserted from the left side of the main body 34 is guided through the upper channel 34*c* and channel 34*d* to the right connecting terminal 35. The upper channel 34*c* of each pair of the channels 34*c* on the left side and the upper channel 34*d* of each pair are located at the same height. For example, these upper lead wires 9 are soldered to the right connecting terminal 35. On the other hand, the lower lead wire 9 of each pair is guided through the lower channel 34*c* and connected to the left connecting terminal 35. Meanwhile, the lower lead wire 9 of each pair of the lead wires 9 inserted from the right side of the main body 34 is guided through the lower channel 34*c* and channel 34*d* and connected to the left connecting terminal 35. The lower channel 34*c* of each pair of the channels 34*c* on the right side and the lower channel 34*d* of each pair are formed at the same height. The upper lead wire 9 of each pair is guided through the upper channel 34*c* and connected to the right connecting terminal 35. Each wire of the power cord 13 is passed through the channels 34*e* and 34*f*, and connected to one of the connecting terminals 35. The other ends of the power cord 13 are connected to the connecting terminals 35 of the middle junction member 31, respectively.

The lid 33 has a substantially flat shape corresponding to the shape of the upper face of the main body 34 of the upper junction member 30. Formed on the rear surface of the lid 33 are the lugs 33*a* which fit into the sockets 34*h* of the main body 34.

The lid 33 fits into the main body 34 wired as shown in FIG. 16. In order to prevent the penetration of water into the junction member 30, the gap between the lid 33 and the main body 34, and the channels 34*c* and 34*e* are fully sealed by filling a potting material, such as epoxy resin and silicon rubber. Namely, the potting material not only fills up the gap between the lid 33 and the main body 34, but also adheres the lid 33 and the main body 34 together. The installation of the upper junction member 30 is complete by fastening the base of the main body 34 to the heat transfer plate 22 with the adhesive agent.

The middle junction member 31 is formed by the lid 33 shown in FIG. 14 and a main body 36 shown in FIG.

18. The configurations of the main body 36 and the above-mentioned main body 34 are substantially the same. The main body 36 includes lead-wire inserting sections 36*a* and connecting-terminal mounting sections 36*b*, channels 36*c* and 36*d* for the lead wires 9, channels 36*e* and 36*f* for the power cord 13, locating lugs 36*g*, and sockets 36*h*. The lead-wire inserting sections 36*a* and the connecting-terminal mounting sections 36*b*, the channels 36*c*, 36*e*, 36*e* and 36*f*, the locating lugs 36*g* and the sockets 36*h* correspond to the lead-wire inserting sections 34*a*, the connecting-terminal mounting sections 34*b*, the channels 34*c*, 34*e*, 34*d* and 34*f*, the locating lugs 34*g* and the sockets 34*h*, respectively.

The difference between the main body 36 and the main body 34 is that the channels 36*e* and 36*f* for the power cord 13 connected to the upper junction member 30 are also formed in the upper end of the main body 36 and the ribs for separating the upper portions of the connecting-terminal mounting sections 36*b*, respectively. In the middle junction member 31, therefore, as illustrated in FIG. 16, not only the lead wires 9 of the heaters 23 and the power cord 13 are connected to the connecting terminals 35, but also the power cord 13 connected to the upper junction member 30 is inserted into the main body 36 through the upper channels 36*e* and 36*f* and connected to the connecting terminals 35. Assembling the main body 36 and the lid 33 and mounting the middle junction member 31 on the heat transfer plate 22 are performed in the same manner as in the case of the upper junction member 30.

Figure 19:
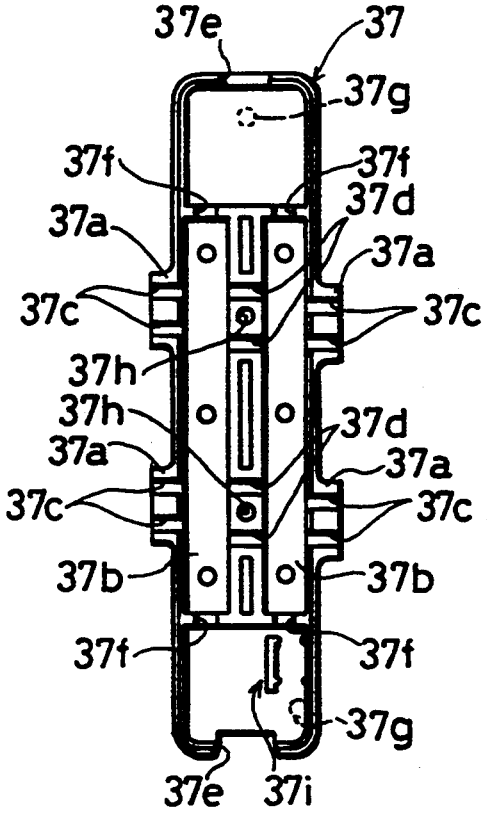
FIG. 19 is a front view of the main body of the lower junction member shown in FIG. 9.

The lower junction member 32 is formed by the lid 33 shown in FIG. 14 and a main body 37 shown in FIG. 19. The configurations of the main body 37 and the main body 36 of the middle junction member 31 are substantially the same. The main body 37 includes lead-wire inserting sections 37*a*, connecting-terminal mounting sections 37*b*, channels 37*c* and 37*d* for the lead wires 9, channels 37*e* and 37*f* for the power cord 13, locating lugs 37*g*, and sockets 37*h*. The lead-wire inserting sections 37*a*, the connecting-terminal mounting sections 37*b*, the channels 37*c*, 37*e*, 37*d* and 37*f*, the locating lugs 37*g* and the sockets 37*h* correspond to the lead-wire inserting sections 36*a*, the connecting-terminal mounting sections 36*b*, the channels 36*c*, 36*d*, 36*e* and 36*f*, the locating lugs 36*g* and the sockets 36*h*, respectively.

Figure 20:
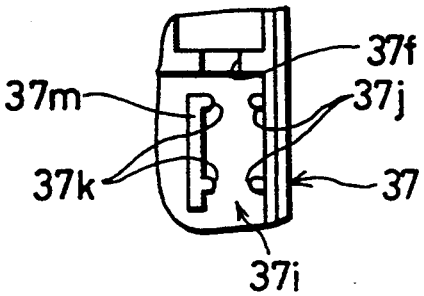
FIG. 20 is an enlarged view of the holder section shown in FIG. 19.

The difference between the main body 37 and the main body 36 is that a power-cord holder section 37*i* is formed on one side of the main body 37 near the lower channel 37*e*. With this arrangement, since the power cord 13 inserted from the lower channel 37*e* is held by the power-cord holder section 37*i*, it is possible to prevent an external tensile force from causing a faulty connection of the power cord 13 and the connecting terminals 35 and to prevent the power cord 13 from being disconnected from the main body 37. As illustrated in FIG. 20, the power-cord holder section 37*i* is constituted by two projections 37*j* formed on the side wall of the main body 37 and a partition 37*m* positioned to face the side wall. The partition 37*m* has projections 37*k* facing the projections 37*j* on the side wall.

Thus, in the main body 37, as shown in FIG. 16, not only the lead wires 9 of the heaters 23 and the power cord 13 are connected to the connecting terminals 35, but also the power cord 13 connected to the middle junction member 31 is inserted into the main body 37 through the upper channels 37*e* and 37*f* and connected to the connecting terminals 35. The power cord 13 inserted through the lower channel 37*e* is connected to an external power supply. Assembling the main body 37 and the lid 33 and mounting the lower junction member 37 on the heat transfer plate 22 are performed in the same manner as in the case of the upper junction member 30.

Figure 21:
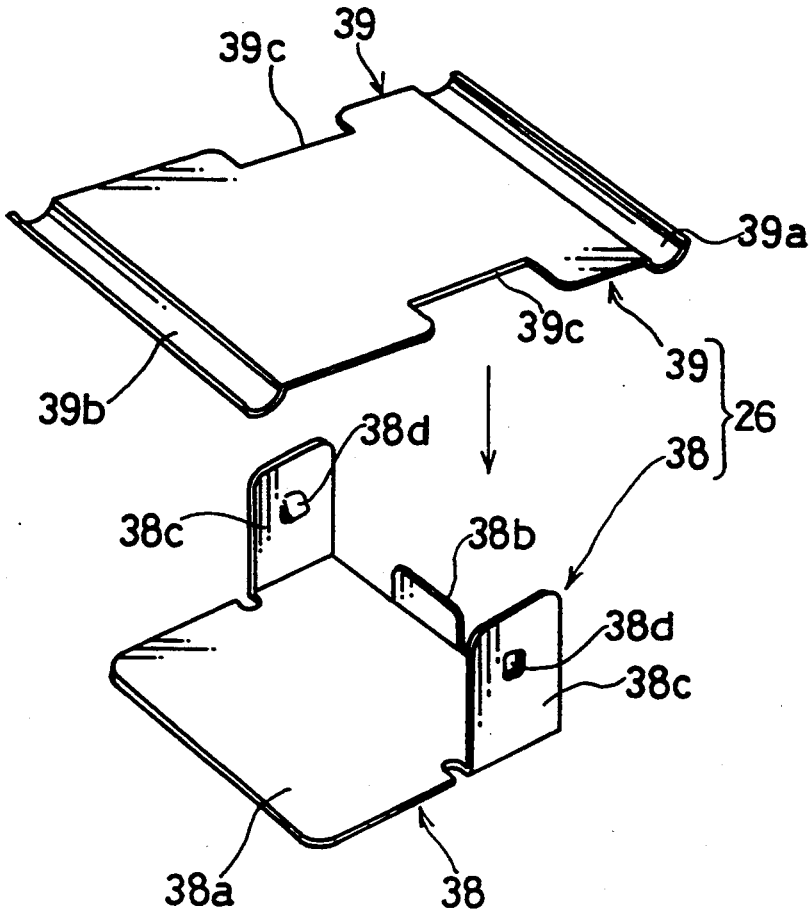
FIG. 21 is a perspective view of a disassembled fixture shown in FIG. 9.

As illustrated in FIG. 21, the fixture 26 is formed by a base member 38 and a fastening member 39. The base member 38 includes a contact section 38*b* raised upright from an end of a flat base section 38*a*. Formed on each side of the contact section 38*b* is an upright section 38*c* extending upright from an edge of the base section 38*a*. The upright sections 38*c* face each other. Each of the upright sections 38*c* has a raised portion 38*d* which was formed by cutting and raising a portion of the upright section 38*c*. The raised portions 38*d* slope so that the distance between the raised edges is smaller than the distance between the bases of the raised portions 38*d*.

The fastening member 39 is made of a plate spring and has a curved fastening section 39*a* at one end and a curved contact section 39*b* at the other end. The plate spring has resilient properties and is made of, for example, a 0.3 mm thick SUS304-H. A cut portion 39*c* is formed in the both sides of the fastening member 39 so as to correspond to the distance between the upright sections 38*c* of the base member 38.

Figure 22:
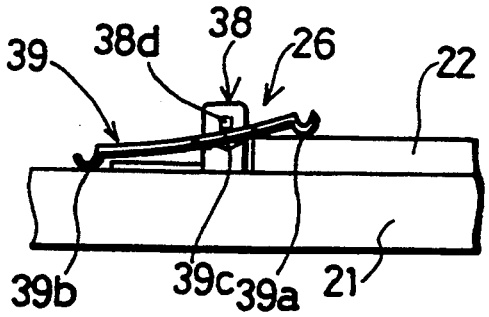
FIG. 22 is an explanatory view illustrating an installation of a mirror on a heat transfer plate with the fixture.
Figure 23:
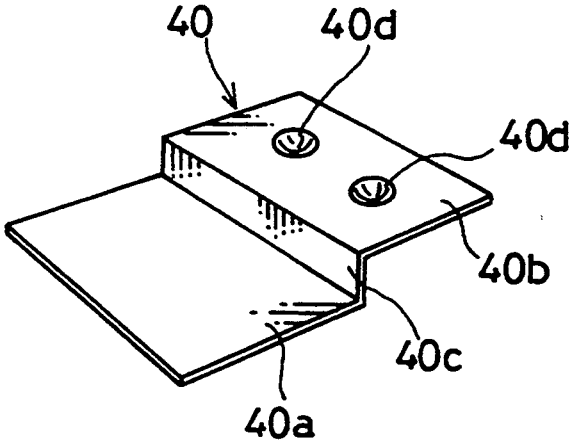
FIG. 23 is a perspective view illustrating a fixture to be used instead of the fixture shown in FIG. 21.

For example, as illustrated in FIG. 9, two fixtures 26 are mounted on each side and a lower end of the heat transfer plate 22. The contact section 38*b* of the base member 38 is brought into contact with a side edge of the mirror 21 and the base section 38*a* is fastened to the rear surface of the mirror 21 with an adhesive agent. As illustrated in FIG. 22, when the fastening member 39 is attached to the base member 38, the raised portions 38*d* of the base member 38 fit into the cut portions 39*c* of the fastening member 39, the contact section 39*b* comes into contact with the heat transfer plate 22, and the fastening section 39*a* presses the rear surface of the heat transfer plate 22. Namely, the heat transfer plate 22 is fastened to mirror 21 by pressure.

When assembling the anti-condensation mirror 41 of this configuration, the heaters 23 and the power cord 13 are respectively connected to the upper, middle and lower junction members 30, 31 and 32 as described above. Subsequently, waterproof treatment is applied to these junction members 30, 31, and 32. Next, they are mounted on the heat transfer plate 22 to give an anti-condensation unit shown in FIG. 9. And, the base members 38 of the fixtures 26 are fastened to predetermined positions of the rear surface of the mirror 21 with an adhesive agent. The predetermined positions are determined so that the locating sections 38*b* come into contact with the heat transfer plate 22 when the base members 38 are fastened to the rear surface of the mirror 21. Then, the heat transfer plate 22 is mounted on the rear surface of the mirror 21, and the fastening members 39 are attached to the respective base members 38.

When attaching the fastening member 39 to the base member 38, the fastening member 39 is first positioned over the mirror 21 and the heat transfer plate 22. At this time, the cut portions 39*c* of the fastening member 39 are aligned with the upright sections 38*c* of the base member 38. Next, when the portion between the cut portions 39*c* is pressed downward, the cut portions 39*c* moves downward in contact with the raised portions 38*d* of the base member 38. When a downward force is cancelled at the time the cut portions 39*c* pass through the lower ends of the raised portions 38*d*, the raised portions 38*d* engage with the cut portions 39*c* due to spring and the fastening member 39 is thus attached to the base member 38. As a result, the heat transfer plate 22 is secured closely to the rear surface of the mirror 21 by pressure.

As described above, with the anti-condensation mirror 41 of this embodiment, since the heat transfer plate 2 is mounted on the mirror 21 with the fixtures 26 without using an adhesive agent, it is possible to prevent the mirror 21 from curving due to a difference in the linear expansion coefficient between the mirror 21 and the heat transfer plate 22. Even when the heat transfer plate 22 is mounted on the mirror 21 with an adhesive agent, if the thickness of a layer of the adhesive agent is increased to absorb the difference in the linear expansion coefficient, it is possible to prevent the mirror 21 from curving. In this case, however, the conduction of heat to the mirror 21 is lowered. As a result, less anti-condensation effects are produced on the mirror 21, and the cost and the thickness of the anti-condensation mirror increase.

The installation of the heat transfer plate 22 with the fixtures 26 is performed through the following process. Firstly, the base member 38 is attached to the mirror 21. Secondly, the heat transfer plate 22 is mounted on the mirror 21. Thirdly, the fastening member 39 is attached to the base member 38 to fasten the heat transfer plate 22 closely to the mirror 21. With this arrangement, during installation, there is no need to slide the heat transfer plate 22 over the mirror 21, preventing the mirror 21 from being scratched.

Moreover, since the heat transfer plate 22 is fastened to the rear surface of the mirror 21 by fitting the fastening member 39 made of a resilient material into the base member 38, mounting the heat transfer plate 22 on the mirror 21 and dismounting the heat transfer plate 22 from the mirror 21 for the purpose of, for example, replacing the heaters 23 become easier.

As for the fixture used for fastening the heat transfer plate 22 to the mirror 21, it is not necessary to use only the fixtures 26 having the base members 38 and fastening members 39. For example, two fixtures 26 fastening one of the sides of the heat transfer plate 22 shown in FIG. 29 may be replaced with simpler fixtures 40, shown in FIG. 23. The fixture 40 includes a flat mounting section 40*a*, a step-like fastening section 40*b* substantially parallel to the mounting section 40*a*, and a locating section 40*c* between the mounting section 40*a* and the fastening section 40*b*. When fastening the heat transfer plate 22 to the mirror 21 with the fixtures 40, the mounting section 40*a* is mounted on the rear surface of the mirror 21, the locating section 40*c* locates the heat transfer plate 22 in proper position, the fastening section 40*b* is placed over the heat transfer plate 22, and fastening portions 40d of the fastening section 40*b* protruding toward the heat transfer plate 22 press the heat transfer plate 22 against the mirror 21.

In the anti-condensation mirror 41 of this embodiment, for example, the lead wires 9 of three sets of four heaters 23 are connected to the power cord 13 through the corresponding junction members 30, 31 and 32, respectively. With the arrangement, the lead wires 9 of a number of heaters 23 are connected more easily to the power cord 13 compared to the arrangement shown in FIG. 1 where the lead wires 9 are directly connected to the power cord 13. Moreover, with this arrangement, it is possible to reduce the lengths of the lead wires 9 and to make the lengths of the lead wires 9 substantially even, facilitating the manufacture of heaters 23. Also, waterproof treatment is applied more easily to the connections of the heaters 23 and the power cord 13. Furthermore, this arrangement prevents the lead wires 9 from getting loosened and caught in other member.

In addition, since the heaters 23 and the junction members 30, 31 and 32 have the locating lugs 28*b*, 29*a* and 34*g* for locating them in correct positions on the heat transfer plate 22, they are easily mounted on the heat transfer plate 22.

It is possible to incorporate a fuse in the junction members 30, 31 and 32, or only in the lower junction member 32 closest to the power cord 13. In this case, since the heaters 23 and the power cord 13 are connected in parallel and the power cord 13 are connected to the junction members 30, 31 and 32 in series through the connecting terminals 35, the connecting terminals 35 are connected to the power cord 13 through the fuses if installed in the junction members 30, 31 and 32. In the case when the fuse is installed only in the lower junction member 32, the power cord 13 inserted into the lower junction member 32 is connected to the connecting terminals 35 through the fuse.

The number of the junction members is not restricted to three and is changed suitably, for example, according to the area of the heat transfer plate 22. For instance, the total number of the junction members is changed by changing the number of the middle junction member 31. As for the positions of the respective junction members, it is not necessary to arrange them into a line, and they may be arranged on two lines crossing each other. Similarly, the number and positions of the heaters 23 connected to the junction members are changed suitably.

[EMBODIMENT 3]

The following description discusses a third embodiment of the present invention with reference to FIGS. 24 through 31. The members having the same function as in the above-mentioned embodiment are designated by the same cord and their description are omitted.

Figure 24:
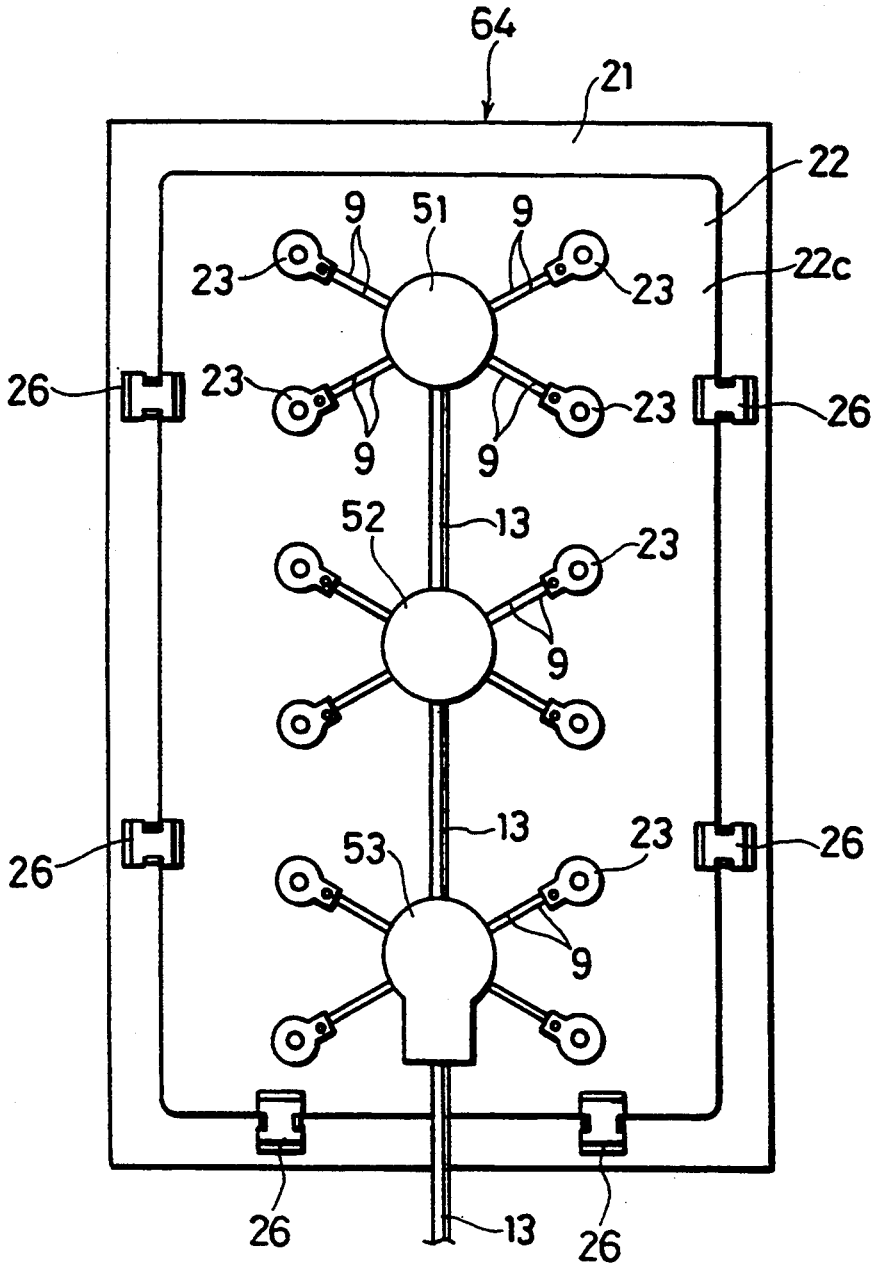
FIG. 24 is a rear view of an alternative anti-condensation mirror of the present invention.

As illustrated in FIG. 24, an anti-condensation mirror 64 of this embodiment includes an upper junction member 51, a middle junction member 52 and a lower junction member 53 instead of the junction members 30–32 of the second embodiment shown in FIG. 9. Except for these changes, the anti-condensation mirror 64 is constructed in the same manner as the anti-condensation mirror 41 is constructed.

Figure 25:
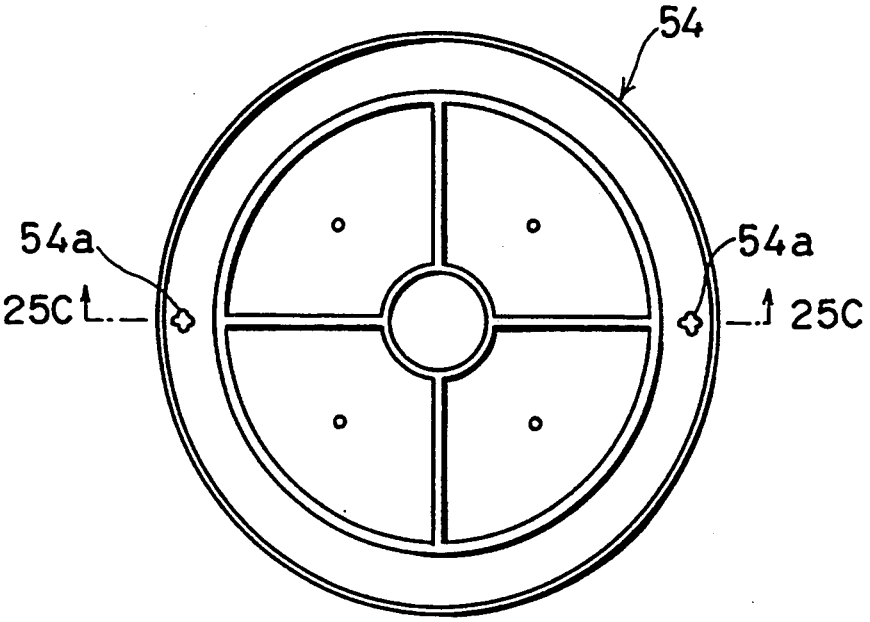
FIG. 25(*a*) is a front view of the lid of the upper junction member shown in FIG. 24, FIG. 25(*b*) is a side view thereof, FIG. 25(*c*) is a vertical section cut across line C—C of FIG. 25(*a*)
Figure 25:
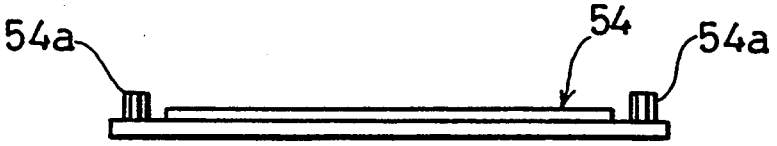
Figure 25:
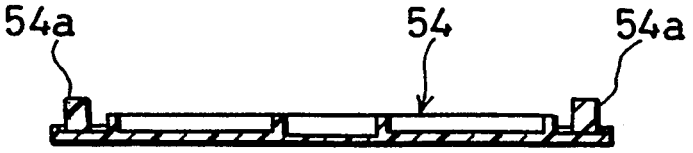
Figures 26A, 26B, 26C, 26D, 26E:
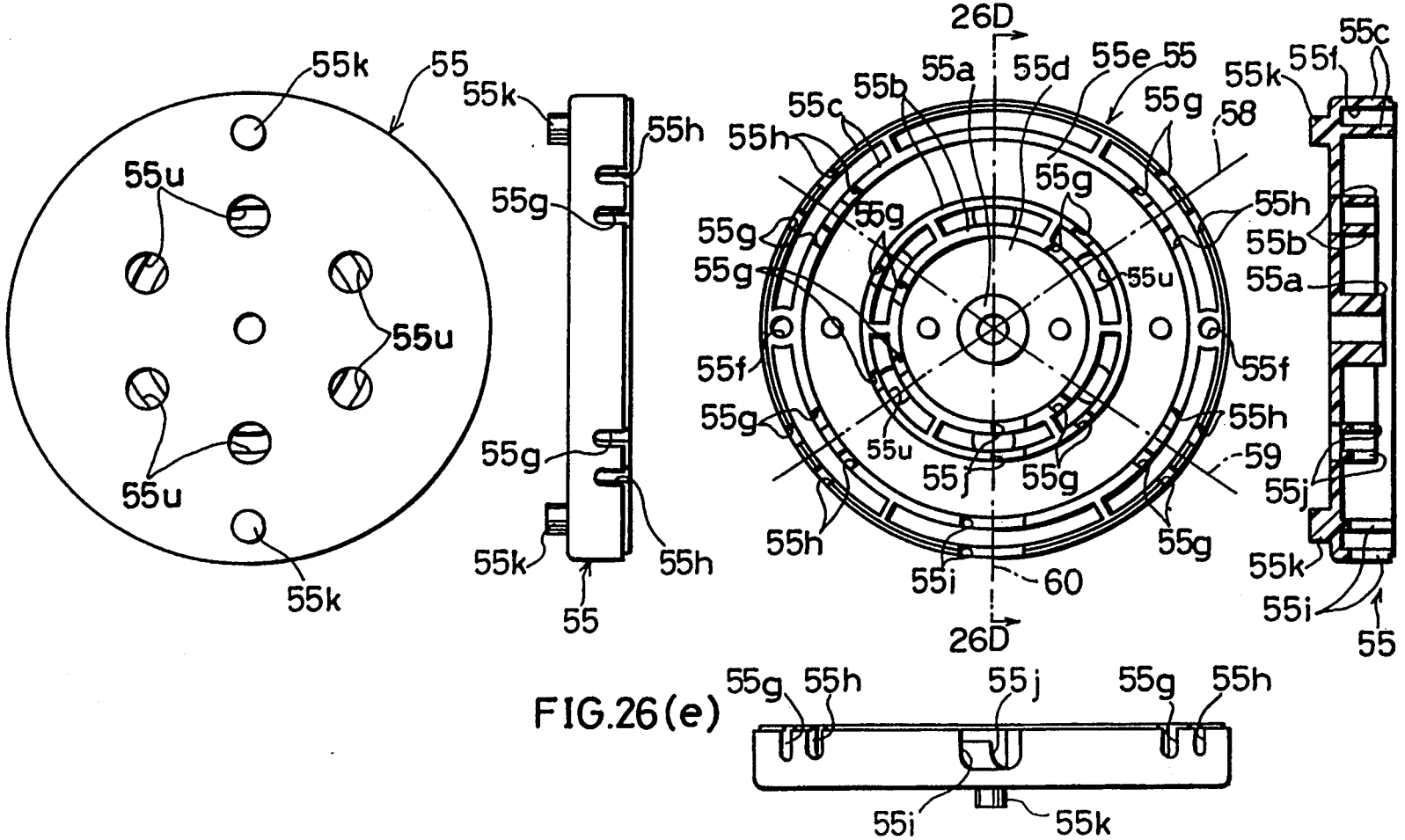
FIG. 26(*a*) is a rear view of the main body of the upper junction member shown in FIG. 24, FIG. 26(*b*) is a side view thereof, FIG. 26(*c*) is a front view thereof, FIG. 26(*d*) is a vertical section cut across line D—D of FIG. 26(*c*), and FIG. 26(*e*) is a bottom view thereof.

The upper junction member 51 is formed by a lid 54, shown in FIGS. 25(*a*) through 25(*c*), and a main body 55, shown in FIGS. 26(*a*) through 26(*c*).

The main body 55 is formed in the shape of a flat circular container with a cylindrical projection 55*a* at the center. The main body 55 has outer double-ring-shaped ribs 55*c* at the periphery and inner double-ring-shaped ribs 55*b* at the middle position between the outer ribs 55*c* and the cylindrical projection 55*a*. With this arrangement, an inner connecting-terminal mounting section 55*d* is formed between the cylindrical projection 55*a* and the inner ribs 55*b*, and an outer connecting-terminal mounting section 55*e* is formed between the inner ribs 55*b* and the outer ribs 55*c*. An inner connecting terminal 56 made of flat-ring-shaped brass, shown in FIGS. 27 and 28(*a*), is placed in the inner connecting-terminal mounting section 55*d*. And, an outer connecting terminal 57, shown in FIGS. 27 and 28(*b*), is placed in the outer connecting-terminal mounting section 55*e*. The inner connecting terminal 56 and the outer connecting terminal 57 are located to be concentric with the main body 55. The main body 55 has sockets 55*f* at locations where the outer ribs 55*c* are placed, so that lugs 54*a* of the lid 54, to be described later, fit into the sockets 55*f*.

As illustrated in FIG. 26(*c*), the main body 55 has channels 55*g* and 55*h* for the lead wires 9. The channels 55*g* are provided to guide the lead wires 9 of the heaters 23 to the inner connecting terminal 56, while the channels 55*h* are provided to guide the lead wires 9 to the outer connecting terminal 57. The channels 55*g* are formed in portions of the inner and outer ribs 55*b* and 55*c* located on one side of two imaginary lines 58 and 59. The imaginary lines 58 and 59 extend in diametrical directions of the main body 55 and cross each other at the center of the cylindrical projection 55*a*. On the other hand, the channels 55*h* are formed in portions of the outer ribs 55*c* located on the other side of the two imaginary lines 58 and 59. Channels 55*i* are formed in portions of the outer ribs 55*c* located on an imaginary bisector 60 of the imaginary lines 58 and 59, and channels 55*j* are formed in portions of the inner ribs 55*b* located on the imaginary bisector 60. The channels 55*i* are provided for the insertion of the power cord 13, while the channels 55*j* are provided for guiding one of the wires of the power cord 13 inserted through the channels 55*i* to the inner ribs 56. The main body 55 is mounted on the heat transfer plate 22 so that the channels 55*i* face downward.

Figure 27:
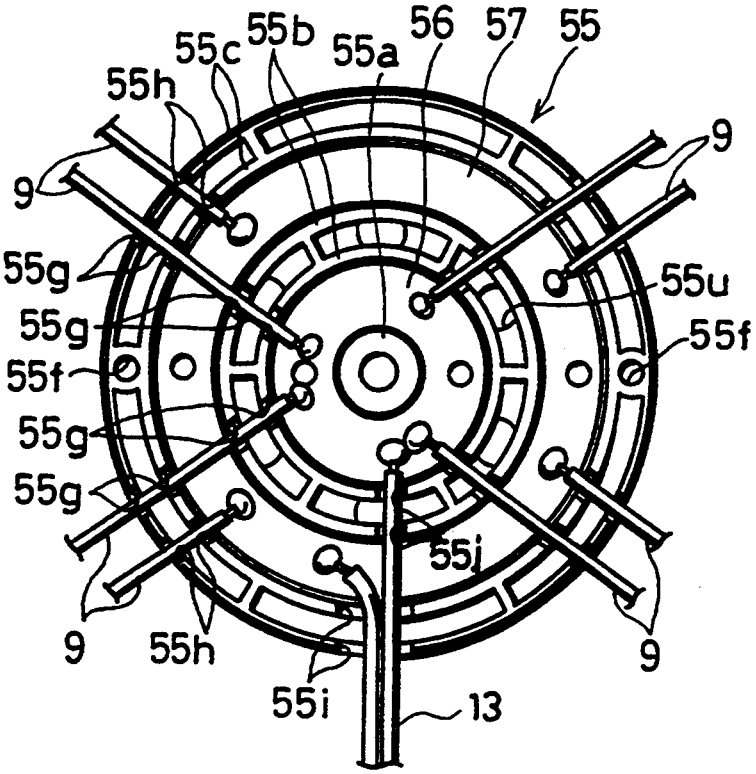
FIG. 27 is a front view illustrating the connections between the lead wires of the heaters and power cord and the main body of the upper junction member.
Figure 28A:
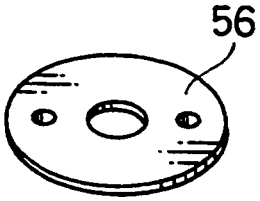
FIG. 28(*a*) is a perspective view of the inner connecting terminal shown in FIG. 27 and FIG. 28(*b*) is a perspective view of the outer connecting terminal shown in FIG. 27.
Figure 28B:
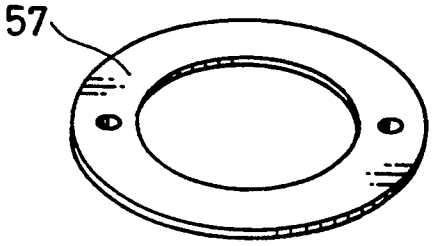

A plurality of filler holes 55*u* as through holes for injecting the potting material are formed in portions between the inner ribs 55*b* at predetermined intervals. Moreover, two locating lugs 55*k* are formed on the rear surface of the main body 55 as shown in FIGS. 26(*a*) and 26(*b*). The locating lugs 55*k* locate the upper junction member 51 in position when mounting the upper junction member 51 on the heat transfer plate 22. On the other hand, locating holes, not shown, corresponding to the locating lugs 55*k* are formed in the heat transfer plate 22. As illustrated in FIG. 27, the lead wires 9 of the heaters 23 and the power cord 13 are connected to the main body 55. More specifically, one of the lead wires 9 of each heater 23 passes through the channels 55*g* and is connected to the inner connecting terminal 56, while the other lead wire 9 passes through the channels 55*h* and is connected to the outer connecting terminal 57. The power cord 13 is inserted into the main body 55 through the channels 55*i*. One of the wires of the power cord 13 is connected to the outer connecting terminal 57, while the other wire further goes through the channels 55*j* and is connected to the inner connecting terminal 56.

The lid 33 shown in FIG. 25 is formed in the shape of a circle corresponding to the shape of the upper face of the main body 55, and has lugs 54*a* in the lower face so that they fit into the sockets 55*f* of the main body 55. After fitting the lid 54 into the main body 55 shown in FIG. 27, waterproof treatment is applied to the upper junction member 51. At this time, the potting material is injected into the upper junction member 51 through the filler holes 55*u* of the main body 55.

Figure 29:
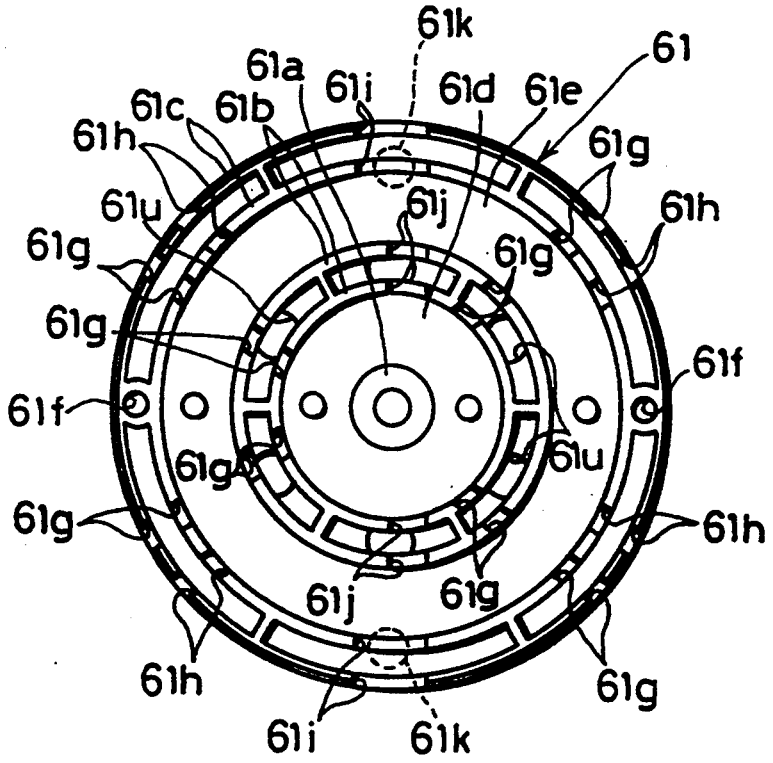
FIG. 29 is a front view of the main body of the middle junction member shown in FIG. 24.

The middle junction member 52 is formed by a lid 54, shown in FIG. 25, and a main body 61, shown in FIG. 29. The configuration of the main body 61 is substantially the same as that of the main body 55. More specifically, the main body 61 includes a cylindrical projection 61*a*, inner ribs 61*b*, outer ribs 61*c*, an inner connecting-terminal mounting section 61*d*, an outer connecting-terminal mounting section 61*e*, sockets 61*f*, channels 61*g* and 61*h* for the insertion of the lead wires 9, channels 61*i* and 61*j* for the insertion of the power cord 13, locating lugs 61*k* and filler holes 61*u* for the injection of a potting material. The cylindrical projection 61*a*, inner ribs 61b, outer ribs 61*c*, inner connecting-terminal mounting section 61*d*, outer connecting-terminal mounting section, sockets 61*f*, channels 61*g*, 61*h*, 61*i* and 61*j*, locating lugs 61*k* and filler holes 61*u* correspond to the cylindrical projection 55*a*, inner ribs 55*b*, outer ribs 55*c*, connecting-terminal mounting section 55*d*, outer connecting-terminal mounting section, sockets 55*f*, channels 55*g*, 55*h*, 55*i* and 55*j*, locating lugs 55*k* and filler holes 55*u*, respectively. Furthermore, the main body 61 includes the channels 61*i* and 61*j* for the insertion of the power cord 13 at upper portions of the outer and inner ribs 61*c* and 61*b*.

Thus, the lead wires 9 of the heaters 23 and the power cord 13 are also connected to main body 61 as illustrated in FIG. 27. The power cord 13 connected to the upper junction member 51 is inserted into the middle junction member 52 through the upper channels 61*i* and 61*j*, and connected to the inner and outer connecting terminal 56 and 57.

Figure 30A:
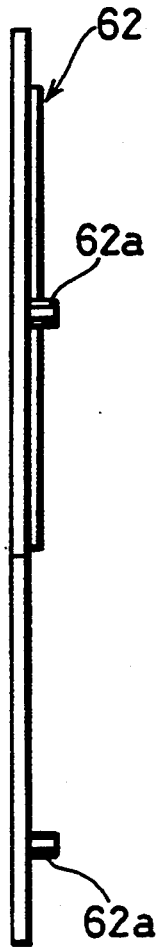
FIG. 30(*a*) is a side view of the lid of the lower junction member shown in FIG. 24 and FIG. 30(*b*) is a front view thereof.
Figure 30B:
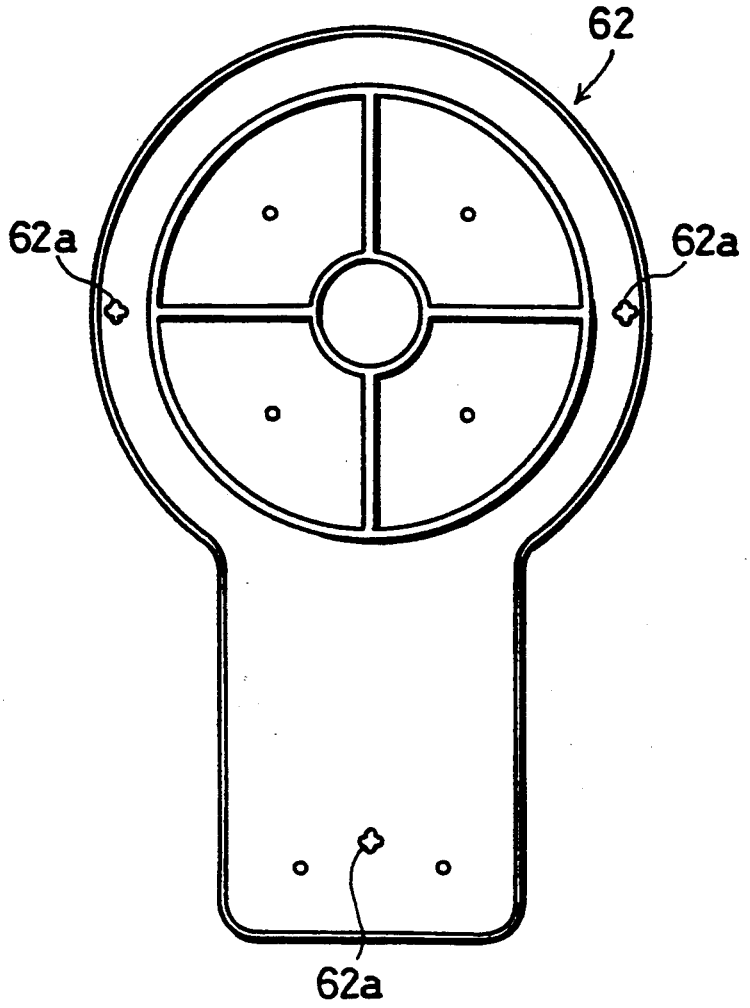
Figures 31A, 31B, 31C, 31D:
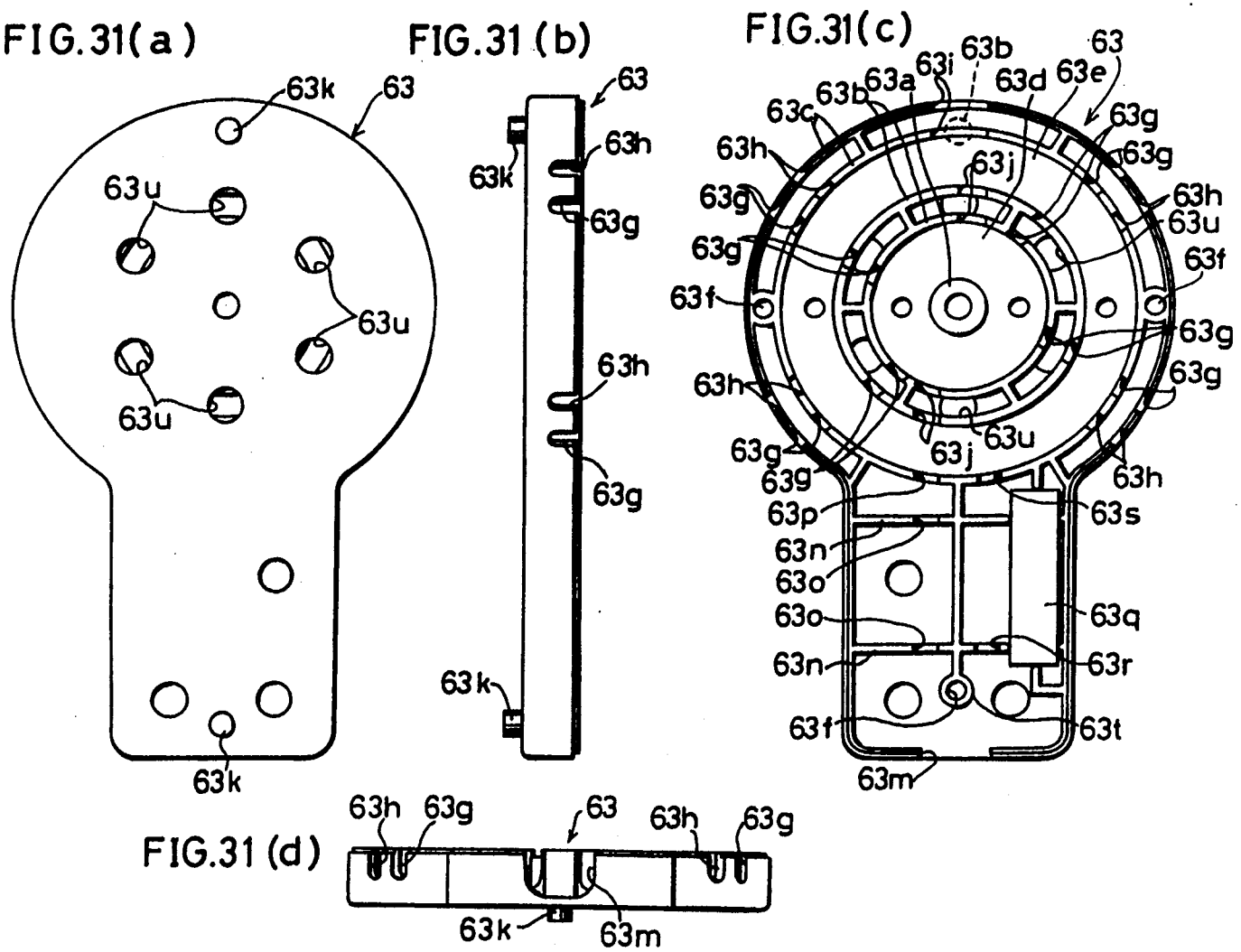
FIG. 31(*a*) is a rear view of the main body of the lower junction member shown in FIG. 24, FIG. 31(*b*) is a side view thereof, FIG. 31(*c*) is a front view thereof, and FIG. 31(*d*) is a bottom view thereof.

The lower junction member 53 is formed by a lid 62, shown in FIG. 30, and a main body 63, shown in FIG. 31. The main body 63 is a flat circular container whose configuration is substantially the same as that of the main body 61 of the middle junction member 52.

More specifically, formed in the upper part of the main body 63 are a cylindrical projection 63*a*, inner ribs 63*b*, outer ribs 63*c*, an inner connecting-terminal mounting section 63*d*, an outer connecting-terminal mounting section 63*e*, sockets 63*f*, channels 63*g* and 63*h* for the lead wires 9, channels 63*i* and 63*j* for the power cord 13, locating lugs 63*k* and filler holes 63*u* for the injection of a potting material. The cylindrical projection 63*a*, inner ribs 63*b*, outer ribs 63*c*, inner connecting-terminal mounting section 63*d*, outer connecting-terminal mounting section, sockets 63*f*, channels 63*g*, 63*h*, 63*i* and 63*j*, locating lugs 63*k* and filler holes 63*u* correspond to the cylindrical projection 61*a*, inner ribs 61*b*, outer ribs 61*c*, inner connecting-terminal mounting section 61*d*, outer connecting-terminal mounting section, sockets 61*f*, channels 61*g*, 61*b*, 61*i* and 61*j*, locating lugs 61*k* and filler holes 61*u*, respectively.

Thus, the lead wires 9 of the heaters 23 are also connected to the upper part of the main body 63 as illustrated in FIG. 27. Through the upper channels 63*i* and 63*j*, the power cord 13 connected to the middle junction member 52 is inserted into the lower junction member 53 and connected to the inner and outer connecting terminals 56 and 57.

Additionally, a channel 63*m* for the power cord 13 is formed in the lower part of the main body 63, and a fuse mounting section 63*q* is formed in a side portion thereof. The channel 63*m* is provided so that the power cord 13 connected to an external power supply is inserted into the main body 63. One of the wires of the power cord 13 which is inserted into the main body 63 through the channel 63*m* passes through the channels 63*o* formed in ribs 63*n* extending in a cross direction, a channel 63*p* formed in the outer rib 63*d* and the channels 63*j* formed in the inner ribs 63*b*, and is connected to the inner connecting terminal 56 in the inner connecting-terminal mounting section 63*d*. On the other hand, the other wire of the power cord 13 passes through a channel 63*r* and is connected to a fuse, not shown, on the fuse mounting section 63*q*. This wire goes through the other end of the fuse and a channel 63*s* formed in an outer rib 63*c*, and is connected to the outer connecting terminal 57 on the outer connecting-terminal mounting section 63*e*. A socket 63*f* is formed in a cylindrical projection on the lower part of the main body 63.

The lid 62 shown in FIG. 30 is flat and has a shape corresponding to that of the upper face of the main body 63, and has lugs 62*a* in the lower face. The lugs 62*a* fit into three sockets 63*f* of the main body 63.

With this structure, since each of the connecting terminal 56 and 57 to which the lead wires 9 of the heaters 23 are connected has a circular shape, the positions of the heaters 23 with respect to the junction members 51, 52 and 53 on the heat transfer plate 22 are easily determined.

Additionally, in the lower junction member 53, since the fuse mounting section 63*q* is formed in the lower portion of the main body 63, the fuse is easily placed. With this structure, if one of the heaters 23 has a problem, electricity is not conducted to any heaters 23. Furthermore, it is possible to form the fuse mounting sections 63*q* in the upper and middle junction members 51 and 52. In this case, only the heaters 23 connected to the junction members 51, 52 and 53 are connected to the power cord 13 through the fuse.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heater comprising:

a heating element made of a thermistor having a positive temperature coefficient of resistance;

electrodes formed on upper and lower surfaces of said heating element;

a pair of flat metallic terminals electrically connected to said electrodes;

a pair of feeders electrically connected to inner surfaces of said metallic terminals, said inner surfaces facing each other; and an electrical insulating cover member for covering exposed portions of said heating element, said electrodes, and of said metallic terminals, and connections between said metallic terminals and said feeders so as to insulated them from outside wherein said electrical insulating cover member comprises an insulating base section integrally formed in said electric insulating cover member which defines a holding position of a heating unit in said electric insulating cover member, said heating unit including said heating element, said electrodes and said metallic terminals connected to said feeders.

2. The heater according to claim 1, wherein each of said metallic terminals includes a feeding portion extending outside of said electrode, and one of said feeders is connected to said feeding portion.

3. The heater according to claim 2, wherein said feeding portions have said inner surfaces.

4. The heater according to claim 1, wherein one of said feeders is connected to one of said metallic terminals at a first position, the other feeder is connected to the other metallic terminal at a second position, said first position being located on one side of a plane perpendicular to said electrodes, said second position being located on the other side of said plane.

5. The heater according to claim 4, wherein said feeders are pulled from said insulating cover member so that said feeders are parallel to a mounting surface of said insulating cover member to be mounted on a heated object and that a distance from said mounting surface to each of said feeders becomes uniform.

6. The heater according to claim 1, wherein said heater is flat, and includes a locating lug formed on a surface to be mounted on a heated object, said locating lug fitting into a locating hole formed in said heated object so as to locate said heater in position.

7. The heater according to claim 1, wherein said heater is flat, and includes a locating lug, formed in a non-mounting surface opposite to a mounting surface to be mounted on a heated object, for preventing said non-mounting surface from being mounted on said heated object.

8. The heater according to claim 1, further comprising cap means for holding said heating element having said electrodes and the pair of said plate-like metallic terminals in close contact with each other.

9. A heater as claimed in claim 1, wherein said electrodes are respectively bonded to said metallic terminals with a conductive adhesive agent.

10. A heater as claimed in claim 1, wherein said electrical insulating cover member further comprises:

a first cover member and

11. A heater as claimed in claim 10 wherein said insulating base section comprises a heating element holding member and a feeder holding member.

12. A heater as claimed in claim 10, wherein said first member and said insulating base section each comprise orientation members.

13. The heater according to claim 1, wherein said insulating cover member includes a lower cover member having a surface to be closely attached to said heated object, and an upper cover member to be mounted on said insulating base section.

14. The heater according to claim 13, wherein said upper cover member and said insulating base section are formed from an electrical insulating material.

15. The heater according to claim 13, wherein said upper cover member and said insulating base section are formed from electrical insulating materials of similar characteristics.

16. The heater according to claim 13, wherein said electrical insulating material forming said upper cover member is selected from material having a thermal conductivity lower than a thermal conductivity of said insulating base section by considering affinity and thermal expansion coefficient of said upper and lower cover member.

17. The heater according to claim 13, further comprising cap means having at least an open bottom, wherein said heating element having said electrodes are sandwiched between the pair of said metallic terminals, located on said insulating base section, and covered from a top thereof with said cap means.

18. A method for manufacturing a heater comprising the steps of:

forming a heating unit by connecting a flat metallic terminal to each of electrodes formed on upper and lower surfaces of a flat heating element made of a thermistor having a positive temperature coefficient of resistance and by connecting feeders to said metallic terminals;

disposing said heating unit at a predetermined holding position on an insulating base section integrally formed in an electric insulating material which defines said predetermined holding position of a heating unit and said metallic terminals in said electric insulating material, said heating unit including said heating element, said electrodes and said metallic connected to said feeders; and sealing exposed portions of said heating unit in an electrical insulating cover member by injection-molding said insulating material after disposing said substrate in a mold.

19. The method of manufacturing a heater according to claim 18, wherein each of said heating element, said electrodes, and of said metallic terminals has a locating hole, said locating hole going from one of surfaces of said heating unit through the other surface thereof, said insulating base section has a locating lug to be inserted into said locating hole, and wherein said locating lug of said insulating base section is inserted into said locating hole of said heating unit when said heating unit is disposed on said insulating base section.

20. The method of manufacturing a heater according to claim 18, wherein connecting of said feeders to said metallic terminals includes connecting said feeders to inner surfaces of said metallic terminals that face each other.

21. The method of manufacturing a heater according to claim 18, wherein said step of forming said heating unit further including putting cap means of insulating material on said heating element so as to attach said metallic terminals directly to said electrodes and allow connecting of said feeders to said metallic terminals, said cap means having at least an open bottom.

22. An anti-condensation mirror comprising:

a mirror;

a heat transfer plate closely attached to a rear surface of said mirror; and a plurality of heaters each covered with an individual electrical insulating cover member and mounted on a rear surface of said heat transfer plate, each of said heaters including therein a flat heating element made of a thermistor having a positive temperature coefficient of resistance.

23. The anti-condensation mirror according to claim 22, wherein each of said heating elements comprises electrodes formed on upper and lower surfaces thereof, and wherein each of said heaters includes a pair of flat metallic terminals electrically connected to said electrodes of said heating elements, and a pair of feeders electrically connected to said metallic terminals.

24. The anti-condensation mirror according to claim 22, wherein said feeders are connected to inner surfaces of said metallic terminals that face each other.

25. The anti-condensation mirror according to claim 24, wherein each of said metallic terminals includes a feeding portion extending outside of said electrode, and one of said feeders are connected to said feeding portion.

26. The anti-condensation mirror according to claim 25, wherein said feeding portions having said inner surfaces.

27. The anti-condensation mirror according to claim 24, wherein one of said feeders is connected to one of said metallic terminals at a first position, the other feeder is connected to the other metallic terminal at a second position, said first position being located on one side of a plane perpendicular to said electrodes, said second position being located on the other side of said plane.

28. The anti-condensation mirror according to claim 27, wherein said feeders are pulled from said insulating cover member so that said feeders are parallel to a mounting surface of said insulating cover member to be mounted on a heated object and that a distance from said mounting surface to each of said feeders becomes uniform.

29. The anti-condensation mirror according to claim 22, wherein each of said heaters is flat, and includes a locating lug formed on a surface to be mounted on said heat transfer plate, said locating lug fitting into a locating hole formed in said heat transfer plate so as to mount said heater in position.

30. The anti-condensation mirror according to claim 22, wherein said heater is flat, and includes a locating lug, formed in a non-mounting surface opposite to a mounting surface to be mounted on said heat transfer plate, for preventing said non-mounting surface from being mounted on said heat transfer plate.

31. An anti-condensation mirror comprising:

a mirror;

a heat transfer plate mounted on a rear surface of said mirror;

a plurality of heaters covered with an electrical insulating cover member and mounted on a rear surface of said heat transfer plate, each of said heaters including therein a flat heating element made of a thermistor having a positive temperature coefficient of resistance; and a fixture for fastening said mirror closely to the rear surface of said heat transfer plate, said fixture including a base member attached to the rear surface of said mirror and a fastening member of a resilient material, said fastening member pressing said heat transfer plate against said mirror by engaging with said base member.

32. The anti-condensation mirror according to claim 31, wherein said base member of said fixture comprises a contact section for locating said heat transfer plate in position, said contact section facing an edge of said heat transfer plate.

33. The anti-condensation mirror according to claim 31, wherein said base member of said fixture comprises a flat substrate to be mounted on the rear surface of said mirror, vertical walls extending from both sides of said substrate to face each other, a portion protruding from each of inner surfaces of said vertical walls, and wherein said fastening member is disposed over said heat transfer plate and said mirror so that one of ends of said fastening member is mounted on said heat transfer plate and the other end is mounted on the rear surface of said mirror, a portion between said two ends is curved toward said mirror, and said heat transfer plate is fastened by engaging both sides of said curved portion with said protruding portions.

34. The anti-condensation mirror according to claim 31, wherein said fixture is mounted at least on two edges among two side edges and lower edge of said heat transfer plate, and a one-piece fixture is mounted on the remaining one edge, and wherein said one-piece fixture comprises a flat section to be mounted on the rear surface of said mirror, a contact section for locating said heat transfer plate in position, said contact section facing an edge of said heat transfer plate, and a fastening section for pressing a rear surface of said heat transfer plate against said mirror.

35. An anti-condensation mirror comprising:

a mirror;

a heat transfer plate closely attached to a rear surface of said mirror;

a plurality of heaters covered with an electrical insulating cover member and mounted on a rear surface of said heat transfer plate, each of said heaters including therein a flat heating element made of a thermistor having a positive temperature coefficient of resistance; and a junction member mounted on the rear surface of said heat transfer plate, said junction member having therein a connection area where feeders of said heating elements and a power cord are connected, said junction member covering connections between said feeders and said power cord.

36. The anti-condensation mirror according to claim 35, wherein spaces including said connection area in said junction member are filled up with a potting material for preventing a penetration of moisture.

37. The anti-condensation mirror according to claim 35, including a plurality of said junction members, each of said junction members comprising a connecting terminal in said connection area to which said feeders of said heating elements are connected, wherein a plurality of said heating elements are connected to each of said junction members with said connecting terminals, and said junction members are connected to each other with said connecting terminals and said power cord.

38. The anti-condensation mirror according to claim 37, wherein said junction member comprising a connecting terminal in said connection area to which said feeders of said heating elements are connected, and each of said connecting terminals has a circular shape, a center point of each of said connecting terminals being substantially aligned with a center point of said connection area.

* * * * *